United States Patent [19]

Vettel

[11] Patent Number: 4,889,646

[45] Date of Patent: Dec. 26, 1989

[54] NITROGEN CONTAINING DISPERSANTS TREATED WITH MINERAL ACIDS

[75] Inventor: Paula R. Vettel, Downers Grove, Ill.

[73] Assignee: Amoco Corporation, Chicago, Ill.

[21] Appl. No.: 68,902

[22] Filed: Jun. 30, 1987

[51] Int. Cl.[4] ..... C10M 133/00; C10M 135/00

[52] U.S. Cl. ..... 252/32.7 E; 252/39; 252/47.5; 252/51; 252/51.5 R; 252/51.5 A; 252/52 R

[58] Field of Search ..... 252/51.5 A, 47.5, 33, 252/51.5 R

[56] References Cited

U.S. PATENT DOCUMENTS

| | | | |
|---|---|---|---|
| 3,328,436 | 6/1967 | Erlemann et al. | 252/51.5 A |
| 3,341,455 | 9/1967 | Coleman | 252/51.5 A |
| 3,368,972 | 2/1968 | Otto | 252/51.5 R |
| 3,422,017 | 1/1969 | Dadara | 252/49.9 |
| 3,452,002 | 6/1969 | Brasch | 252/51.5 A |
| 3,649,659 | 3/1972 | Otto et al. | 252/33 |
| 3,649,661 | 3/1972 | Otto et al. | 44/72 |
| 3,798,247 | 3/1974 | Piasek et al. | 252/51.5 R |
| 3,826,746 | 7/1974 | Schick et al. | 252/51.5 A |
| 3,985,802 | 10/1976 | Piasek et al. | 252/51.5 R |
| 4,269,606 | 5/1981 | Bonazza et al. | 252/51.5 A |
| 4,338,205 | 7/1982 | Wisotsky | 252/32.5 |
| 4,344,771 | 8/1982 | Bonazza et al. | 252/51.5 A |
| 4,379,064 | 4/1983 | Cengel et al. | 252/51.5 A |
| 4,425,245 | 1/1984 | Cahill et al. | 252/51.5 R |
| 4,425,249 | 1/1984 | Cahill et al. | 252/51.5 R |
| 4,428,849 | 1/1984 | Wisotsky | 252/51.5 A |
| 4,455,244 | 6/1984 | Smyser et al. | 252/51.5 A |
| 4,648,980 | 3/1987 | Erdman | 252/32.5 |
| 4,699,724 | 10/1987 | Nalesnik et al. | 252/51.5 A |

FOREIGN PATENT DOCUMENTS

| | | |
|---|---|---|
| 61329 | 9/1982 | European Pat. Off. . |
| 136185 | 4/1985 | . |
| 2038840 | 7/1980 | United Kingdom . |
| 2140811 | 12/1984 | United Kingdom . |

*Primary Examiner*—William R. Dixon, Jr.
*Assistant Examiner*—E. McAvoy
*Attorney, Agent, or Firm*—Matthew R. Hooper; William H. Magidson; Ralph C. Medhurst

[57] ABSTRACT

A dispersant composition comprising the reaction product of an ashless dispersant selected from the group consisting of (i) Mannich dispersants, (ii) succinimide dispersants, (iii) succinate ester-amide dispersants, and (iv) polymeric viscosity index improvers having amine dispersant character, with an inorganic mineral acid selected from the group consisting of sulfuric, nitric and hydrochloric acids.

32 Claims, No Drawings

NITROGEN CONTAINING DISPERSANTS TREATED WITH MINERAL ACIDS

This invention relates to engine lubricant compositions comprising nitrogen containing dispersants wherein the dispersants are pre-treated with mineral acids to reduce the tendency of the dispersants to attack fluorohydrocarbon-type engine seals and also to improve the water tolerance of lubricant compositions comprising such dispersants. More particularly, the invention is directed to a lubricant composition comprising the reaction product obtained by reacting a dispersant containing basic nitrogen groups with a mineral acid selected from the group consisting of sulfuric, nitric, and hydrochloric acids where the amount of acid reacted with the dispersant is from about 25% to about 300% of that required to neutralize the dispersant.

Fluorocarbon elastomers are commonly used in assembling internal combustion engines. The seals prevent leakage of lubricants at the point where moving parts, such as the crankshaft, leave the engine. As discussed in Erdman U.S. Pat. Nos. 4,615,826 and 4,648,980 a well-known problem associated with fluorocarbon elastomers is their susceptibility to attack by basic nitrogen-containing amine dispersants typically found in lubricating oil compositions. This attack consists of base-promoted dehydrofluorination and cross-linking of the elastomer causing a loss of both elasticity and tensile strength, and ultimately a deterioration of the elastomer until it fails to adequately prevent leakage of the lubricant from the crankcase.

Erdman U.S. Pat. No. 4,615,826 discloses passivation of the basic nitrogen groups of amine dispersants by reaction thereof with fluorophosphoric acid. Although the acid treatment of Erdman is said to improve the engine seal compatibility of the dispersants treated in accordance with that patent, it is generally desirable to maintain phosphorus levels in a lubricant composition at the lowest possible levels due to the known deleterious effect of phosphorus on the operation of catalytic converters. Therefore, introduction of added levels of phosphorus is commercially unattractive.

U.S. Pat. No. 3,422,017 discloses oil additives which are the reaction product of primary, secondary or tertiary monoamines containing up to 30 carbon atoms and fluorophosphoric acid.

Wisotsky U.S. Pat. Nos. 4,338,205 and 4,428,849 disclose treatment of alkenylsuccinimide dispersants with oil soluble strong acids such as alkylated benzene sulfonic acid and hydrocarbyl substituted derivatives of phosphoric acid. While such treatment is said to enhance dispersancy, there is no discussion of the compatibility of the compositions described in these patents with fluorocarbon seals.

Otto U.S. Pat. Nos. 3,649,659 and 3,649,661 disclose a product obtained by reacting a Mannich dispersant with a metal-containing coordinating agent prepared from metal and various inorganic and organic acids, including sulfuric acid.

Karol U.S. Pat. No. 4,548,724 discloses the reaction of polyacids such as 1,3,6-hexane tricarboxylic acid and alkenyl succinimides.

None of the references above teach or suggest treatment of oil soluble nitrogen dispersants with a mineral acid selected from the group of sulfuric, nitric and hydrochloric acids for the purpose of improving compatibility of the dispersant with fluorocarbon engine seals, or for the purpose of enhancing the water tolerance of lubricant compositions comprising the dispersants.

A further problem associated with nitrogen-containing dispersants is control of water sensitivity in the overall lubricant formulation which typically contains other conventional additive compositions such as phenates and sulfonates. In heavy-duty formulations high levels of sulfonate and phenate detergents can interact with dispersants having high levels of nitrogen to produce haze and sediment when trace amounts of water (0.05–0.20%) are present in the formulation. The result is a product which is unacceptable from the customer's standpoint. While the substitution of dispersants having lower nitrogen levels can alleviate this problem, it is generally preferred to use high nitrogen dispersants to attain excellent dispersancy performance. Accordingly, in addition to solving the fluorocarbon seal problem, the objects of the present invention include modifying high nitrogen dispersants in such a manner as to render motor oil lubricant formulations containing such dispersants less sensitive to water. Other objects appear hereinafter.

I have now found that the objects of the present invention are achieved in a dispersant composition comprising the reaction product of an ashless dispersant selected from the group consisting of (i) Mannich dispersants, (ii) succinimide dispersants, (iii) succinate ester-amide dispersants, and (iv) polymeric viscosity index improvers having amine dispersant character, with an inorganic mineral acid selected from the group consisting of sulfuric, nitric and hydrochloric acids. The dispersant is reacted with the acid at 200° to 400° F. and the amount of acid used is about 25 to about 300% of that required to neutralize the basic dispersant and preferably about 100 to 200% of such amount.

The invention is further directed to additive packages comprising the dispersant-acid reaction product of the present invention plus other optional additives and also to lubricating oil compositions containing a major amount of an oil of lubricating viscosity and a minor amount of the dispersant-acid reaction product of the present invention. The lubricating oil compositions of the present invention preferably include alkaline earth metal sulfonates and phenates, and a VI improver (dispersant and non-dispersant), along with the acid-treated dispersant of the invention. Supplemental non-acid pretreated succinimide or succinate ester-amide dispersants, and/or zinc dialkyldithiophosphate can also be included.

Among the advantages in using the mineral acid treatment of the present invention to partially or completely neutralize basic nitrogen containing ashless dispersants, is the ability to render such dispersants much less antagonistic toward fluorocarbon engine seals. This is particularly important in heavy duty formulations containing dispersants with higher nitrogen levels. Such formulations, especially those also containing an amine dispersant viscosity index improver, generally have been very difficult to pass in industry tests which measure the compatibility of the dispersant-containing formulations with Viton® elastomer seals. As subsequent examples will demonstrate, heavy duty formulations containing the acidtreated dispersants of the present invention readily pass these Viton® tests.

Another important advantage of the present invention is the ability to reduce water sensitivity in heavy duty formulations which combine high levels of detergents such as low base and high base alkaline earth metal sulfonates and phenates, with dispersants containing high levels of nitrogen. Due to the interaction of these additives, unacceptable haze and sediment can form. The acid-dispersant reaction products of the present offer a simple and inexpensive solution to this problem.

The nitrogen containing dispersants suitable for acid treatment according to the present invention preferably are selected from the group consisting of (1) Mannich base dispersants; (2) alkenyl succinimide dispersants; (3) succinate ester-amide dispersants; and (4) VI improvers having Mannich dispersant character.

Mannich Base Dispersants

Generally speaking, the Mannich base dispersants suitable for use in the present invention result from the condensation under Mannich reaction conditions of a hydroxyaromatic compound, an aldehyde yielding reagent, and an amine. Preferably the reactants are: (a) a high molecular weight alkyl-substituted hydroxyaromatic compound whose alkyl substituent has a number average molecular weight of about 600 to 100,000, preferably a polyalkylphenol whose polyalkyl substituent is derived from 1-mono-olefin polymers (preferably polybutene) having an Mn of about 850–2500; (b); an amine containing at least one primary or secondary NH group, preferably an alkylene polyamine of the formula $$NH_2\left(A-\underset{\underset{H}{|}}{N}\right)_x H-$$

wherein A is a divalent alkylene radical having 2 to 6 carbon atoms and is an integer from 1 to 10; and (c) an aldehyde, preferably formaldehyde, paraformaldehyde or formalin. Representative examples of Mannich base dispersants are shown in Piasek et al U.S. Pat. Nos. 3,697,574; 3,703,536; 3,704,308; 3,751,365; 3,756,953; 3,798,165; 3,798,247; and 3,803,039. For a more complete understanding of the Mannich reaction see "Organic Reactions," Vol. 1, pages 303 to 341 (1942) published by John Wiley & Sons, Inc.

In somewhat greater detail, a representative class of high molecular weight alkyl-substituted hydroxyaromatic compounds suitable for preparation of the Mannich base dispersant are the polyalkyl phenols which can be obtained by the alkylation, in the presence of an alkylating catalyst, such as $BF_3$, of phenol with high molecular weight polypropene, polybutene and other polyalkylene compounds to give alkyl substituents on the benzene ring of phenol having an average 600–100,000 Mn. Such preparations using a $BF_3$:phenol catalyst are well known in the art.

The alkyl-substituents on the hydroxyaromatic compounds may be derived from high molecular weight polypropenes, polybutenes and other polymers of mono-olefins, principally 1-mono-olefins, preferably polybutenes. Also useful are copolymers of mono-olefins with monomers copolymerizable therewith wherein the copolymer molecule contains at least 90%, by weight, of mono-olefin units. Specific examples are copolymers of butenes (butene-1, butene-2 and isobutylene) with monomers copolymerizable therewith wherein the copolymer molecule contains at least 90%, by weight, of propylene and butene units, respectively. Said monomers copolymerizable with propylene or said butenes include monomers containing a small proportion of unreactive polar groups such as chloro, bromo, keto, ethereal, aldehyde, which appreciably lower the oil-solubility of the polymer. The comonomers polymerized with propylene or said butenes may be aliphatic and can also contain non-aliphatic groups, e.g., styrene, methylstyrene, p-dimethylstyrene, divinylbenzene and the like. From the foregoing limitation placed on the monomer copolymerized with propylene or said butenes, it is abundantly clear that said polymers and copolymers of propylene and said butenes are substantially aliphatic hydrocarbon polymers. Thus, the resulting alkylated phenol contain substantially alkyl hydrocarbon substituents having Mn upward from 600. A preferred molecular weight is from about 850 to 2500 Mn.

In addition to these high molecular weight hydroxyaromatic compounds others which may be used include those which have been used to prepare low molecular weight Mannich condensation products, e.g., high molecular weight alkyl-substituted derivatives of resorcinol, hydroquinone, cresol, catechol, xylenol, hydroxydiphenyl, benzylphenol, phenethylphenol, naphthol, tolylnaphthol, among other. Preferred for the preparation of the Mannich dispersants useful in this invention are the polyalkylphenol reactants, e.g., polypropylphenol and polybutylphenol where the alkyl group has an average number molecular weight of 600–3000, the most preferred being polybutylphenol whose alkyl group has an average number molecular weight of 850–2500.

Turning now to the primary or secondary amine containing reactant, representative of this class of reactants are alkylene polyamines, principally polyethylene polyamines. Other representative organic compounds containing at least one HN< group suitable for use in the preparation of Mannich condensation products are well known and include polyalkylpolyamines, the mono and diamino alkanes and their substituted analogs, e.g., ethylamine and diethanolamine; aromatic diamines, e.g., phenylenediamine, di-aminonaphthalenes; heterocyclic amines, e.g., morpholine, pyrrole, pyrrolidine, imidazole, imidazolidine, and piperidine; melamine and their substituted analogs.

Suitable alkylene polyamine reactants include ethylene-diamine, diethylene triamine, triethylene tetramine, tetraethylene pentamine, pentaethylene hexamine, hexaethylene hepta-amine, heptaethylene octamine, octaethylene nonamine, nonaethylene decamine and decaethylene undecamine and mixture of such amines having nitrogen contents corresponding to the alkylene polyamines, in the formula $H_2N-(A-N-H-)_nH$, mentioned before, where A is divalent ethylene and n is 1 to 10. Corresponding propylene polyamines such as propylene diamine and di-, tri-, tetra-, penta-propylene tri-, tetra-, penta- and hexa-amines are also suitable reactants. The alkylene polyamines are usually obtained by the reaction of ammonia and dihalo alkanes, such as dichloroalkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

The ethylene amines are especially preferred. They are described in some detail under the heading "Ethylene Amines" in the Kirk & Othmer *Encyclopedia of Chemical Technology.*

The above-mentioned reaction of ammonia and dihalo alkanes can result in the production of a somewhat complex mixture of alkylene amines, including cyclic condensation products such as piperazines. Such mixtures can be used to manufacture the Mannich base dispersant. On the other hand, quite satisfactory products can be obtained also by use of pure alkylene amines, i.e., the tetraethylene pentaamine mentioned above.

Another useful amine product for use in manufacturing the Mannich base dispersant is a commercially available mixture of alkylene polyamines approximating tetraethylenepentaamine available under the trade name "DOW E-100" from Dow Chemical Company.

Representative aldehyde reactants contemplated for use in the preparation of the high molecular weight Mannich condensation products of this invention include the aliphatic aldehydes such as formaldehyde (also as paraformaldehyde and formalin), acetaldehyde and aldol (b-hydroxybutyraldehyde). We prefer to use formaldehyde or a formalin.

A further Mannich base dispersant suitable for use in the present invention is one which has been modified with an aliphatic acid in accordance with the teachings disclosed in Piasek et al. U.S. Pat. Nos. 3,798,247 and 3,803,039. These patents disclose the aliphatic acid treatment to overcome haze formation during storage of the Mannich dispersant as well as formation of carbonaceous deposits in diesel engines utilizing a Mannich base-containing crankcase lubricant. Preferably, the aliphatic acid has 10–20 carbons per carboxylic acid group, and the respective molar ratios of the alkylsubstituted alkylphenol:amine:formaldehyde yielding reactant:aliphatic acid are preferably about 1:0.7–1.0:1.5–2.1:0.014–0.62.

A suitable aliphatic acid for use in preparing the above modified Mannich base dispersant can have a carbon atom content of a total (including the carbon of the carboxylic acid group) of from about six to about 30 and consists of the alkanoic (saturated) and alkenoic (mono-unsaturated) acids. The upper limit of the carbon content is restricted only by the largest carbon atom content of such acids available or capable of feasible preparation. Such aliphatic acids can be natural and synthetic mono-, di- and tri-carboxylic acids. Suitable natural aliphatic acids are the natural fatty acids obtainable by known hydrolysis (acid and alkaline) of vegetable and animal oils and fats and wax esters. Of those natural acids for the purposes of this invention the preferred acids have from 10 to about 20 total carbon atoms per carboxylic acid group. Suitable synthetic acids can be derived from oxidation of the alcohol moiety of the wax ester where such alcohol moiety has at lest six carbon atoms; from the polymerization of unsaturated natural acids having two or three carbon to carbon double bonds (dimer and trimer acids) and the hydrogenation of residual carbon to carbon double bonds in such polymer acids. For example the polymer acids obtained from oleic acid, euric acid, linoleic acid and linolenic acid and other unsaturated acids; and from oxidation or other reactions of polypropenes and polybutenes (e.g., polyisobutenes) which introduce one or more carboxylic acid group on the polymer chain.

Suitable alkanoic acids having 6 or more total carbon atoms are those obtainable from the glycerides: vegetable oils and animal fats and wax esters by the known hydrolysis or saponification-acidification or acid treatment processing of said oil and fat glycerides and the wax esters (i.e., natural waxes), the oxidation of the mono-alcohol obtainable from the simple ester of the wax esters and known acid synthesis. Such suitable alkanoic acids, i.e., having R groups of 6 to 30 carbon atoms, include caproic acid, caprylic acid, capric acid, hendecylic acid, lauric acid, tridecylic acid, myristic acid, pentadecylic acid, palmitic acid, margaric acid, stearic acid, nonadecylic acid, arachidic acid, medullic acid, behenic acid, lignoceric acid, pentacosoic acid, cerotic acid, heptacosoic acid, monocosoic acid, montanic acid, and melissic acid. Many of said alkanoic acids are obtained first in mixtures of two, three or more alkanoic acids of different carbon contents from said glycerides and wax esters. Said mixtures can be used in this invention in place of a single alkanoic acid reactant. When said mixtures of alkenoic acids also contain unsaturated acids it is preferred that such mixture of acids be reduced to a product which is substantially free of unsaturation.

Suitable alkanoic acids having a total of at least six carbon atoms include those from hexenoic, heptenoic, octenoic, etc., acids up to oleic ($C_{18}$) and erucic ($C_{22}$) acids. Also suitable are the dimer acid of linoleic and its saturated dimer analog; dimer and trimer acids of linolenic acid and the saturated dimer and trimer analogs. Other polymeric acids, e.g., co-dimers of oleic and linoleic or linolenic acids and the saturated analogs of those dimer acids are also suitable mixtures of acids are also contemplated for use such as for example "Emery 894" consisting principally of $C_{16}$ and $C_{18}$ monobasic acids.

In terms of manufacture the high molecular weight Mannich base dispersant for use in the present invention can be prepared by the conventional technique of adding the aldehyde to a heated mixture of the alkylsubstituted hydroxyaromatic and amine reagents, in the presence or absence of a solvent and then heating the resultant mixture to a temperature between 100° and 350° F. until dehydration is complete.

A solvent such as benzene, toluene, xylene, methanol and others easily separated from the reaction mixture or light mineral oils, such as those used in blending stocks to prepare lubricating oil formulations in which the product is formed as a mineral oil concentrate are usually used. The water by-product is removed by heating the reaction mixture to a temperature sufficiently high, at least during the last part of the process, to drive off the water alone, or as an azeotropic mixture with the aromatic solvent, usually by the aid of an inert stripping gas such as nitrogen, carbon dioxide, etc.

The preferred high molecular weight Mannich base dispersants for use in the present invention are high molecular weight Mannich condensation products formed by reacting (1) a 850–2500 Mn polybutylphenol; (2) an ethylene polyamine characterized by the above-depicted formula, and (3) formaldehyde in the respective molar ratio of 1.0:0.7–1.0:1.5–2.1. These can be prepared by the general method above, or by a two-step condensation method in which the formaldehyde is added in two reaction stages in lieu of adding all of the formaldehyde to reactants (1) and (2) as in the general procedure. For example, when the two-step procedure is employed using a respective reactant molar ratio of 1.0:0.7:1.5, all of the alkylphenol and amine reactant and about two-thirds of the formaldehyde are heated, usually in a solvent such as mineral oil, at approximately 130°–300° F. until dehydration is complete to form an intermediate Mannich condensation product. Thereafter the remaining portion of formaldehyde is added, usually at 150°–300° F., and the resulting mixture heated and maintained at approximately 250°–350° F. from 1 to 5 hours until dehydration is complete to form the final product.

If desired, the Mannich base dispersant can be boronated to provide enhanced protection against wear and corrosion in the formulated lubricant. Suitable boronation methods are taught in Piasek et al. U.S. Pat. Nos. 3,703,536; 3,704,308 and 3,756,953 which are incorporated herein by reference. Generally, boronation of the Mannich dispersant can by achieved by reacting or condensing a boron or boron-containing compound with the Mannich base to provide a boron to nitrogen ratio of about 0.1 to 4.0. Preferably, the boron compound is one reactive and/or coordinative with a polar group such as an hydroxy group and/or a nitrogen containing group present in the Mannich products. Boron compounds having that property of reaction and/or coordination include boron oxide, boron oxide hydrate, boron trifluoride, boron tribromide, boron trichloride, $HBF_4$, boron acids such as boronic acid (e.g., alkyl-$B(OH)_2$ or aryl-$B(OH)_2$, boric acid (i.e., $H_3BO_3$), tetraboric acid (i.e., $H_2B_4O_7$), metaboric acid (i.e., $HBO_2$), amides of such boron acids, and esters of such boron acids. The use of boric acid as the reactant to introduce boron into the high molecular weight Mannich condensation products is preferred. The manner of using such boron reactants with nitrogen-containing compounds in general is known and is disclosed for example in U.S. Pat. Nos. 3,000,916 and 3,087,936 among others.

For a presentation of detailed procedures for preparing boronated Mannich dispersants using the above described boron compounds, one may refer to the examples of U.S. Pat. Nos. 3,756,953, or 3,703,536.

Succinimide Dispersants

The succinimide dispersants that can be used to prepare the lubricating oil additives described herein are disclosed in numerous references and have become exceedingly well known in the art. Certain fundamental types of succinimides and the related materials encompassed by the term "succinimide" are taught in U.S. Pat. Nos. 3,172,892; 3,219,666; and 3,272,746, which contain many examples of their preparation. The term "succinimide" is understood in the art to include many of the amide, imide and amidine species which are also produced by the reactions employed in the preparation of the succinimide material. The predominant product, however, is a succinimide, and this term has been generally accepted as meaning the product of the reaction of an alkenyl substituted succinic acid or anhydride with a nitrogen containing compound.

Another, broader term often used to denote the succinimide dispersant is "carboxylic polyamine dispersant." The polyamine portion thereof is derived from polyamine compounds characterized by a radical of the structure —NH— wherein the two remaining valences of nitrogen are satisfied by hydrogen, amino or organic radicals bonded to said nitrogen. These compounds include aliphatic, aromatic and heterocyclic polyamines. Suitable polyamines for use in preparing the carboxylic polyamine dispersants are identical with those which are described above as being suitable for use in preparing the Mannich polyamine dispersants. Preferred polyamines are the polyalkyleneamines, sometimes referred to as alkylene polyamines or polyalkylene polyamines. The structure of such polyamines is shown above in the discussion of Mannich base dispersants. Of these, the most preferred are the polyethyleneamines containing 2 to 6 ethylene amine units such as diethylene triamine, triethylene tetramine, tetraethylene pentamine and the like, including mixtures thereof such as commercially available "DOW E-100".

The source of the acyl group in the carboxylic polyamine dispersants is an alkylating agent comprising a carboxylic acid-producing compound containing a hydrocarbyl or substituted hydrocarbyl substituent which has at least about 40 and preferably at least about 50 carbon atoms. The terminology "carboxylic acid-producing compound" includes, but is not limited to, carboxylic acids, anhydrides, acid halides, esters, amides, imides and amidines. However, the carboxylic acids and their anhydrides are preferred.

The carboxylic acid-producing compound is usually prepared by the reaction, according to well-known procedures, of a relatively low molecular weight carboxylic acid or derivative thereof with a hydrocarbyl donating agent or hydrocarbon source containing at least about 40 and preferably at least about 50 carbon atoms. The hydrocarbon source is usually aliphatic and should be substantially saturated. More specifically, at least about 95% of the total number of carbon-to-carbon covalent linkages should be saturated. The hydrocarbon source is preferably substantially free from pendant groups containing more than about six aliphatic carbon atoms. The hydrocarbon source can be substituted, and examples of acceptable groups are halide, hydroxy, ether, keto, carboxyl, ester (especially lower carboxyalkoxy), amide, nitro, cyano, sulfoxide and sulfone. The substituents, if present, generally comprise no more than about 10 weight percent of the hydrocarbon source.

The preferred hydrocarbon sources for preparation of the carboxylic acid-producing compound are those derived from substantially saturated petroleum fractions and olefin polymers, particularly polymers of mono-olefins having from 2 to about 30 carbon atoms. The hydrocarbon source can be derived, for example, from polymers of ethylene, propene, 1-butene, isobutene, 1-octene, 3-cyclohexyl-1-butene, 2-butene and 3-pentene. Also useful are copolymers of such olefins with other polymerizable olefinic substances, such as styrene, chloroprene, isoprene, para-methylstyrene and piperylene. In general, these copolymers should contain at least about 80 percent and preferably at least about 95 percent, on a weight basis, of units derived from the aliphatic mono-olefins. Olefin polymers having a number average molecular weight between about 600 and about 5,000 (as determined by gel permeation chromatography) are preferred, although higher polymers having higher molecular weights, for example, from about 10,000 to about 100,000 or higher, can also be used. Polybutene having a molecular weight of from about 850 to 2500 is especially suitable as a hydrocarbon source.

Another suitable hydrocarbon source for preparation of the carboxylic acid-producing compound comprises saturated aliphatic hydrocarbons, such as highly-refined, high-molecular weight, white oils or synthetic alkanes.

In many instances, the hydrocarbon source for use in preparing the carboxylic acid-producing compound should contain an activating polar group. This polar group can serve to facilitate reaction between the hydrocarbon source and a low-molecular weight carboxylic acid or derivative thereof when such a process is used to prepare the carboxylic acid-producing compound. Preferred polar groups are halogen, especially chlorine, but other suitable polar groups include sulfide, disulfide, nitro, mercapto, as well as ketone and aldehyde carbonyl groups.

Any one of a number of known reactions can be employed for the preparation of the carboxylic acid-producing compounds. Thus, an alcohol of the desired molecular weight can be oxidized with potassium permanganate, nitric acid or a similar oxidizing agent; a halogenated olefin polymer can be reacted with a ketone; an ester of an active hydrogen-containing acid, such as acetoacetic acid, can be converted to its sodium derivative and the sodium derivative reacted with a halogenated high-molecular weight hydrocarbon, such as brominated wax or brominated polyisobutene; a high-molecular weight olefin can be ozonized; a methyl ketone of the desired molecular weight can be oxidized by means of the haloform reaction; an organometallic derivative of a halogenated hydrocarbon can be reacted with carbon dioxide; a halogenated hydrocarbon or olefin polymer can be converted to a nitrile, which is subsequently hydrolyzed. Preferably, an olefin polymer or its halogenated derivative is reacted with an unsaturated carboxylic acid or derivative thereof, such as acrylic acid, methacrylic acid, maleic acid, maleic anhydride, fumaric acid, itaconic acid, itaconic anhydride, citraconic anhydride, mesaconic acid, glutaconic acid, chloromaleic acid, aconitic acid, crotonic acid, methylcrotonic acid, sorbic acid, 3-hexenoic acid, 10-decenoic acid, 2-pentene-1,3,5-tricarboxylic acid, and the like; or a halogen-substituted carboxylic acid or derivative thereof.

The reaction of an olefin polymer or a halogenated derivative thereof with maleic acid or maleic anhydride is particularly preferred for use in preparation of the carboxylic acid-producing compound. The resulting product is then the well-known hydrocarbyl-substituted succinic acid, or anhydride. The reaction involves merely heating the two reactants at a temperature from about 100° to about 250°° C. The substituted succinic acid or anhydride thus obtained, can, if desired, be converted to the corresponding acid halide by reaction with known halogenating agents, such as phosphorus trichloride, phosphorus pentachloride or thionyl chloride. Preferred is the polybutylsuccinic anhydride.

For the formation of the carboxylic polyamine dispersant, the hydrocarbyl-substituted succinic acid, or anhydride, or other carboxylic acid-producing compound, and a polyamine, such as a polyalkylene polyamine, are heated to a temperature above about 80° C., and preferably from about 100° to about 250° C. The polyamine combines with the carboxylic acid-producing compound through the predominant formation of amide, imide and/or amidine linkages (containing acyl or acylamidoyl groups). In some instances, the polyamine can be combined with the carboxylic acid-producing compound at a temperature below about 80° C. through predominant amine salt formation (containing acyloxy groups). The use of a diluent, such as mineral oil, benzene, toluene, naphtha or the like, is often desirable to facilitate control of the reaction temperature.

In preparing the carboxylic polyamine dispersant, the relative proportions of the carboxylic acid-producing compound and the polyamine starting materials are such that at least about one equivalent weight of the acid producing compound, preferably polybutylsuccinic anhydride, is used for each mole of polyamine.

In an alternative method for producing the carboxylic polyamine dispersant, a polyamine, such as a polyalkylene polyamine, is reacted with a low-molecular weight, unsaturated or halogen-substituted acylating agent, such as a carboxylic acid, or anhydride. The resulting intermediate is then reacted with the hydrocarbon source, as previously described, to give the deslred dispersant.

If desired, the succinimlde dispersants can be borated using, as for example, the methods of Le Seur U.S. Pat. Nos. 3,087,936 and 3,254,025; and Ser. No. 516,879.

Succinate Ester-Amide Dispersants

The term "succinate ester-amide" as used herein for a class of dispersants suitable to undergo acid treatment in the present invention, denotes the reaction product of a long chain aliphatic hydrocarbyl substituted succinic acid or anhydride with an N-substituted hydroxyalkyl amine. Representative patents disclosing this type of ashless dispersant are Malec U.S. Pat. Nos. 4,426,305; and Le Seur 3,219,666, 3,640,904 and 3,282,955, all of which are incorporated by reference.

Preferred succinate-ester amide dispersants for use in the present invention are prepared by reacting an aliphatic long chain succinic acid compound and an alkylene diamine having an average of at least about 0.5 N-hydroxyalkyl groups. In somewhat greater detail, the preferred succinate ester amide dispersant can be prepared by (1) reacting an unsubstituted alkylene diamine with at least 0.5 mols of hydroxyalkylating reagent per mol of alkylene diamine, and (2) reacting the resulting N-hydroxyalkyl alkylene diamine with a polybutylsuccinic anhydride. Optionally, the succinate ester-amide product can be borated in accordance with conventional boration techniques.

The alkylene diamines useful in this invention have the structure $NH_2$-R-$NH_2$ wherein R is an alkylene group of from 2 to 24 carbon atoms, such as ethylene, 1,2-propylene, trimethylene, hexamethylene, dodecamethylene, tetracosene, etc.

Suitable hydroxyalkylating reactants include halohydrins and vicinal epoxides (olefin oxides) containing from 2 to 4 carbon atoms in the alkylating agent, such as ethylene oxide, 1,2-propylene oxide, 1,2-butylene oxide, 2-chloro-1 ethanol, 2-chloro-1-propanol, 3-bromo-1-propanol, 4-chloro-butanol, etc. The vicinal epoxides are preferred because of their relatively high reactivity with the amine groups in the alkylene diamine. The hydroxyalkylating agents can be used in a concentration of about 1 to 6 mols per mole of alkylene diamine.

The alkylene diamine can be hydroxyalkylated under conventional conditions, i.e., by reaction at 50° to 300° C. from 1 to 10 hours.

The long chain aliphatic succinic acid compounds useful preparing the succinate ester-amide are prepared by the techniques described in the preceding section concerning succinimide dispersants. The long chain aliphatic succinic acid compounds are reacted with the N-substituted hydroxyalkyl diamine under conditions normally employed in this art at a temperature of from 0° to 250° C. If desired a solvent such as benzene, toluene, naphtha, lube oil, xylene and n-hexane or the like can be used to facilitate the control of the reaction. From about 0.5 to 2 moles of long chain aliphatic succinic acid compounds can be reacted per mole of N-substituted hydroxyalkyl alkylene diamine.

The succinate ester-amide can be borated with boron oxide, boron dihalides (boron trifluoride, boron tribromide, boron trichloride), boron acids, such as tetraboric acid, metaboric acid and simple esters of the boron acids (trialkyl borates containing 1 to 8 carbon alkyl groups such as methyl, ethyl, n-octyl, 2-ethylhexyl, etc.).

The boron compounds can be reacted with the long chain succinic acid-hydroxy alkylene diamine product at a temperature of from about 50° to 250° C. preferably from about 100° to 170° C. with a sufficient concentration of boron compound to yield a long chain succinic acid product containing at least 0.15 percent by weight boron (including lube oil). The boron compound can be reacted in a ratio of from 0.1 to 10 moles of boron compound per equivalent of starting long chain succinic acid compound in step 1. This step can be carried out in the presence of diluent or solvent.

Polymeric Dispersant/VI Improver

Another class of nitrogen-containing compositions useful in preparing the compositions of this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen containing source to introduce nitrogen-containing functional groups onto the polymer backbone. Commonly used nitrogen sources include any basic nitrogen compound especially those nitrogen compounds and compositions described herein. Preferred nitrogen sources are alkylene amines, such as ethylene amines, alkyl amines, and Mannich bases. Dispersants of these types are disclosed in U.S. Pat. Nos. 3,769,216, 3,872,019, 3,687,905 and 3,785,980, the disclosures of which are incorporated herein by reference. Examples of suitable viscosity index improver dispersants include:

(a) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons;
(b) polymers of $C_2$ to $C_{20}$ olefin with unsaturated $C_3$ to $C_{10}$ mono- or di-carboxylic acid neutralized with amine, hydroxy amine, or alcohols;
(c) polymers of ethylene with a $C_3$ to $C_{20}$ olefin further reacted either by grafting $C_4$ to $C_{20}$ unsaturated nitrogen-containing monomers thereon or by grafting an unsaturated acid onto the polymer backbone and then reacting said carboxylic acid groups with amine, hydroxy amine, or alcohol; and
(d) polymers of ethylene and a $C_3$ to $C_{20}$ olefin further reacted first with oxygen and subsequently with formaldehyde and an amine.

It is preferred that the viscosity index improver dispersant have a number average molecular weight range, as by vapor-phase osmometry, membrane osmometry, or gel permeation chromatography, of 1,000 to 2,000,000, preferably 5,000 to 250,000, and most preferably 10,000 to 200,000.

Typical polymeric viscosity index improver dispersants include copolymers of alkyl methacrylates with N-vinyl pyrrolidone or dimethylaminoalkyl methacrylate, alkyl fumarate-vinyl acetate, N-vinyl pyrrolidone copolymers, post-grafted interpolymers of ethylene-propylene with an active monomer such as maleic anhydride which may be further reacted with an alcohol or an alkylene polyamine, e.g., see U.S. Pat. Nos. 4,059,794, 4,160,739, and 4,137,185; or copolymers of ethylene and propylene reacted or grafted with nitrogen compounds such as shown in U.S. Pat. Nos. 4,068,045, 4,063,058, 4,146,439, and 4,149,984; and styrene/maleic anhydride polymers postreacted with alcohols and amines, ethoxylated derivatives of acrylate polymers, for example, see U.S. Pat. No. 3,702,300.

A preferred polymeric dispersant/VI improver suitable for use in the present invention is that of category (d) above, i.e., the Mannich reaction product of an oxidized ethylene-propylene copolymer, an amine, and a formaldehyde yielding reagent. Commonly assigned U.S. Pat. Nos. 3,864,268; 3,872,019, 4,011,380; 4,131,553; 4,170,562; and 4,444,956 (all of which are incorporated by reference herein) disclose the preparation of such Mannich dispersant/VI improvers.

Acid Treatment of Dispersants

In accordance with the present invention, nitrogen containing dispersants, and preferably the ashless dispersants described at length above, can be treated or modified with a mineral acid selected from the group consisting of sulfuric, nitric and hydrochloric acids in order to obtain a dispersant/ acid reaction product which is passivated toward fluorohydrocarbon engine seals and which, when added to a lubricant additive formulation comprising other additives, imparts to the formulation substantially improved water tolerance, measured in terms of resistance to haze and sediment.

The acid treatment of dispersants according to the present invention generally can be achieved by combining either a dilute or concentrated solution of the desired acid to the finished dispersant. The acid must be combined with a finished dispersant and cannot be included as reactant during the manufacture of the dispersant insofar as dispersant preparation is completely inhibited in the presence of the acid. Neutralization of the basic nitrogen occurs as evidenced by a drop in TBN and presence of sulfate ammonium salt in the IR spectrum of the treated dispersant. The amount of added sulfuric acid varies with the level of desired performance but generally should be from about 25% to about 300% of that required for neutralization, and is preferably from about 100% to about 200% of the amount of acid required for neutralization. Treatment of the dispersants with more than about 300% of the amount of acid required for neutralization is found to be detrimental to dispersancy, while treatment below about 25% of that required for neutralization tends to show little if any improvement in engine seal compatibility and water tolerance effects. Reaction of the dispersant and acid can be carried out at a temperature of from about 175° F. to about 475° F., and preferably about 200° to 400° F. Although the neutralization occurs essentially immediately, the reaction mixture can be maintained at an elevated temperature of preferably 200° to 400° F. under a nitrogen purge to remove diluent water in those instances where the dispersant is treated with dilute acid. The resulting acid neutralized dispersants are clear, dark oils having TBN and TAN values proportional to the amount of acid in the dispersant.

The precise chemical nature of the product which is obtained upon reaction of a basic nitrogen dispersant with the prescribed mineral acids in accordance with the present invention is not well understood. It is necessary therefore that such reaction products be defined through method of preparation. Nevertheless, for purposes of reproducing the present invention, a precise understanding of the chemical interaction which occurs between the acid and the dispersant is not required. Instead, using the test procedures of ASTM D-2896 to measure the drop in TBN of the dispersant as increasing amounts of acid are added, one can readily determine the amount of acid required to just neutralize a given basic nitrogen dispersant, i.e., reduce its TBN (total base number) to 0. It is found that reacting the dispersant with anywhere from about 25 to about 300% of this neutralization amount can impart the benefits of the present invention. A preferred range of acid, as stated above is from about 100 to 200% of the amount of acid required to neutralize the dispersant.

As stated above, ASTM D-2896 can be used to measure the amount of acid needed to neutralize a basic nitrogen containing dispersant for purposes of the present invention. A summary of this procedure is as follows:

1. The weight of the dispersant sample is determined to four decimal places.

2. The titration solvent is a 2:1 (by weight) mixture of chlorobenzene and acetic acid. A volume of 120 ml of this solution is added to the sample in a beaker and the solution is stirred with a magnetic stirrer to dissolve the sample.

3. Titration is carried out using an automatic titrimeter (in this work a Metrohm Herisau Potentiograph E-576 was used) with external electrodes. The electrodes are placed into the solution with the dissolved sample which is stirred continuously by the magnetic stirrer.

4. The titrating solution is an approximately 0.1 Normal perchloric acid acetous solution. The solution is prepared by mixing 8.5 ml of perchloric acid, 500 ml of glacial acetic acid and 30 ml of acetic anhydride. This is then diluted to 1 liter with additional glacial acetic acid. The solution is left to stand 24 hours and then standardized, by titrating into potassium hydrogen phthalate, to determine the exact normality to four decimal places.

5. The dispersant sample in solvent is titrated using the above prepared solution at a rate of 1.0 ml/min by the automatic titrimeter. The end point (i.e. amount in ml of solution to neutralize) is taken at the inflection point of the resulting titration curve plotted by the automatic titrimeter. The plotted curve is removed from the titrimeter and the inflection point is determined and expressed as the ml of solution needed to neutralize the dispersant sample.

6. The TBN (expressed as equivalents of base per gram of sample) is then calculated using the following equation:

$$TBN = \frac{\text{ml tetrant perchloric solution to neutralize sample (end point)} \times 56.1 \times \text{Normality of perchloric acid solution}}{\text{wt. of sample (g)}}$$

Preferably the acid treated dispersants of the present invention are also borated to add a further degree of passivation of the dispersants toward fluorocarbon engine seals. Boration can be effected by any of the well-known techniques disclosed in the prior art. For purposes of the present invention, the sequence in which the dispersants are boronated and acid neutralized is not critical. Boration can be carried out before, after or at the same time as the acid treatment.

If desired, a selected dispersant can be treated with an excess of acid to obtain a highly acidified dispersant, which can then be mixed with unacidified dispersant whereupon, following equilibration, the mixture has a uniform acid content.

The present invention is further directed to an additive package comprising the dispersant-acid reaction products of the present invention optionally formulated with other additives for addition to lubricating oil to obtain a formulated motor oil suitable for usa in an internal combustion engine. Typically such an additive package, often referred to as a concentrate, will contain the dispersant and any other additive at a concentration of about 15 to 85% and preferably about 15 to 50% in a carrier diluent which is a substantially higher concentration than that required in a finished lubricating oil composition. These concentrates simplify the handling and transportation of the additives before their subsequent dilution and use in the final lubricant composition.

The preferred additive packages contemplated for use in accordance with the present invention comprise the dispersant-acid reaction products of the present invention plus zinc dialkyl-dithio-phosphate, alkaline earth metal sulfonates and phenates.

Zinc dialkyldlthioposphate suitable for use in the preferred additive package is prepared by forming a dithiophosphate acid via reaction of a phenol or an alcohol with phosphorus pentasulfide and subsequently neutralizing the dithlophosphoric acid with a zinc compound such as zinc oxide. Representative patents are U.S. Pat. Nos. 2,261,047 and 4,483,775 incorporated by reference.

Alkaline earth metal sulfonates suitable for use in the preferred additive packages are discussed thoroughly in the prior art see GB No. 2,082,619; U.S. Pat. Nos. 2,865,956; 2,956,018; 2,671,430; 3,779,920; 3,907,691; 4,137,184; 4,261,840; and 4,326,972) as are the alkaline earth metal phenates (see U.S. Pat. Nos. 2,680,096; 3,036,917; 3,178,368; 3,194,761; 3,437,595; 3,464,910; 3,779,920; and 4,518,807. The patents mentioned here are all incorporated by reference.

Insofar as the dispersant-acid composition of the present invention provides an improved crankcase lubricating oil, a further embodiment of the invention is a lubricating oil composition comprising a major amount of an oil of lubricating viscosity and a minor dispersant amount of the dispersant-acid composition of the present invention. The dispersant is present at a concentration which maximizes its effectiveness at an acceptable cost, preferably about 2 to about 8 wt % (on a 40% active dispersant basis). The lubricating oil which may be used in this invention includes a wide variety of hydrocarbon oils, such as naphthenic bases, paraffin bases and mixed base oils as well as synthetic oils such as esters and the like. The lubricating oils may be used individually or in combination, and generally have a viscosity from about 100 to 15,000 SUS at 38° C. Preferably the lubricant composition further comprises a VI improver (dispersant or non dispersant). The preferred viscosity index improvers are oxidized ethylene/propylene copolymers and/or their amine modified counterparts obtained by reacting an amine, the oxidized ethylene/propylene copolymer, and an aldehyde under Mannich conditions. Reference may be had to U.S. Pat. Nos. 3,864,268; 3,872,019; 4,011,380 as well as numerous others incorporated by reference.

While the preferred use of the additives and compositions of this invention is the crankcase of internal combustion engines, the final application of the lubricating oil compositions of this invention may be in marine cylinder lubricants as in cross-head diesel engines, crankcase lubricants as in railroads, lubricants for heavy machinery such as steel mills and the like, or as greases for bearings and the like and in transmission fluids. Whether the lubricant is fluid or a solid will ordinarily depend on whether a thickening agent is present. Typical thickening agents include polyurea acetates, lithium stearate and the like.

If desired, other additives may be included in the lubricating oil compositions of this invention. These additives include antioxidants or oxidation inhibitors, dispersants, rust inhibitors, anti-corrosion agents, friction modifiers, and so forth. Also anti-foam agents, stabilizers, anti-stain agents, tackiness agents, anti-chatter agents, dropping point improvers, anti-squawk agents, extreme pressure agents and the like may be included.

The present invention is further described but not limited by the following examples.

EXAMPLE 1

Charge 1292 grams of a solution of polybutylphenol in oil (46% active; 850 m.w.), 62 grams tetraethylene pentaamine, and 185 grams SX-5 base oil to a reaction vessel and heat, with stirring to 150° F. Add 95 grams of formalin, which addition increases the temperature to about 180°-190° F. Thereafter increase the temperature of the reaction mixture to 300° to 320° F. and hold at that temperature for three hours to drive off by-product water. To prepare a dispersant $H_2SO_4$ reaction product of the present invention in an approximate molar ratio of 1 mole of the Mannich base dispersant to 2 moles $H_2SO_4$, charge to a separate reaction vessel 475 grams of the Mannich base dispersant prepared in this example (40% active; m.w. 1900) and heat to 175° F. under nitrogen. Add 53 grams of 37.5% $H_2SO_4$ at once and slowly heat the mixture to 320° F. with a nitrogen purge. Maintain at 320° F. for four hours. A clear dark product results which is ready for use.

EXAMPLE 2

Example 1 is repeated using the same Mannich base dispersant except that the amounts of Mannich base dispersant and 37.5% $H_2SO_4$ used are 475 grams and 5.2 grams, respectively, i.e., a molar ratio of 1:0.2.

EXAMPLE 3

Example 1 is repeated except that the amounts of Mannich base dispersant and 37.5% $H_2SO_4$ used are 475 grams and 10.5 grams, respectively, for a molar ratio of approximately 1:0.4.

EXAMPLE 4

Example 1 is repeated except that the amounts of Mannich base dispersant and 37.5% $H_2SO_4$ used are 475 grams and 19.6 grams for a molar ratio of approximately 1:0.75.

EXAMPLE 5

Example 1 is repeated except that the amounts of Mannich base dispersant and 37.5% $H_2SO_4$ used are 475 grams and 78.4 grams, respectively, for a molar ratio of 1:3.

EXAMPLE 6

Example 1 is repeated except that the amounts of Mannich base dispersant and 37% $H2SO_4$ are 475 grams and 98 grams, respectively, for a molar ratio of 1:3.75.

EXAMPLE 7

The preparations of Examples 1-6 are repeated except that the following reactants and amounts are used for preparation of the Mannich base dispersant: 2500 grams of a solution of polybutylphenol in oil (45.9% active; 1600 m.w.), 64 grams SX-5 base oil, 63 grams tetraethylenepentaamine and 36 grams of formalin. The resulting high molecular weight Mannich base dispersant (50% active; 3400 m.w.) had a viscosity of 1175 SSU (at 210° F.) and a nitrogen content of 0.72%.

EXAMPLE 8

Charge 820 grams of a solution of polybutylphenol in oil (80% active; 1800 m.w.), 820 grams SX-5 base oil and 69 grams tetraethylene pentaamine to a reaction vessel and heat with stirring to 150° F. Add 0.365 mole formaldehyde, stir and heat the reaction mixture to 320°-340° F. and maintain at that temperature for 90 minutes followed by nitrogen injection at 1.5 c.f.h. for one hour at 260° F. Stir the liquid mixture and cool to 180° F. and then add a second 0.365 mole of formaldehyde, followed by stirring and heating to 320°-340° F. Again, maintain at this temperature for 90 minutes, followed by nitrogen sparging at 260° F. for one hour. Filter the liquid reaction product through celite at about 260° F. The finished dispersant has a viscosity (at 210° F.) of 687 SSU, a nitrogen content of 1.4%, a total base number of 30.61 and an activity of 42.5%. To prepare an $H_2SO_4$-Mannich dispersant reaction product according to the present invention in an approximate molar ratio of one mole Mannich dispersant to 2 moles $H_2SO_4$, charge 447 grams of the Mannich base dispersant prepared in this example to a separate reaction vessel and heat to 175° F. under nitrogen. Add 53 grams of 37.5% $H_2SO_4$ at once and slowly heat the mixture to 320° F. with a nitrogen purge. Maintain at 320° F. for four hours. The clear dark product is ready for use.

EXAMPLE 9

Example 8 is repeated except that 25 wt. % nitric acid is used in place of 37% sulfuric acid. The amounts of Mannich base dispersant and $HNO_3$ used are 447 grams and 101 grams, respectively, for a mole ratio of 1:4.

EXAMPLE 10

Example 8 is repeated using the same Mannich base dispersant except that 15.4 wt. % HCl is used in place of 37% $H_2SO_4$. The amounts of Mannich base dispersant and 15.4% HCl used are 494 grams and 96 grams, respectively, for a mole ratio of approximately 1:4.

EXAMPLE 11

The preparations outlined in Example 8-10 are repeated, except the following reactants and amounts are used to prepare the Mannich base dispersant: 3200 grams of a solution of polybutylphenol in oil (50% active; 1600 m.w.), 134 grams triethylenetetraamine, 2700 grams SX-5 base oil, 30 grams formaldehyde (first charge) and 30 grams formaldehyde (second charge).

EXAMPLE 12

Charge 306 grams of a solution of polybutylphenol in oil (38% active; 2000 m.w.), 6 grams diethylenetetraamine and 135 grams SX-5 base oil to a reaction vessel and heat with stirring to 140° F. Initially, add 1.74 grams formaldehyde while stirring the mixture and increasing the temperature to 220° F. Hold at this temperature for 60 minutes, then cool the reaction mixture to 200° F. followed by addition of a second formaldehyde charge of 1.74 grams. Stir and heat the mixture to 300° F. and hold at this temperature for 2 hours for complete reaction of the formaldehyde and amine. Filter the product. The filtrate, a light clear product, had a viscosity of 1531 SSU at 210° F., a specific gravity of 0.8996 at 77° F., a nitrogen content of 0.67 wt. %. To 250 grams of the filtered Mannich product is slowly added boric acid dissolved in dimethylformamide, followed by heating to 340° F. and nitrogen sparging at 2 c.f.h. for 60 minutes to obtain a borate Mannich dispersant having about 0.3% boron. To prepare a borated dispersant-$H_2SO_4$ reaction product according to the present invention having a ratio of approximately 1 mole dispersant to 0.2 moles $H_2SO_4$, charge 657 grams of the borated Mannich dispersant prepared in this example to a reaction vessel and heat to 175° F. under nitrogen. Add 5.2 grams of 37.5 wt. % $H_2SO_4$ to the vessel at once and heat slowly to 320° F. with a nitrogen purge. Maintain at 320° for four hours to remove water. The product is a clear dark oil.

EXAMPLE 13

The preparation of Example 12 is repeated using the same borated Mannich base dispersant except that the amounts of Mannich base dispersant and 37.5% $H_2SO_4$ used are 657 grams and 52.3 grams, respectively, for a molar ratio of borated dispersant to acid of approximately 1:2.

EXAMPLE 14

The preparation of Example 12 is repeated using the same Mannich base dispersant except that the amounts of dispersant and 37.5% $H_2SO_4$ used are 657 grams and 57.5 grams, respectively, for a molar ratio of dispersant to acid of about 1:2.2.

EXAMPLE 15

The preparation of Example 12 is repeated using the same borated Mannich base dispersant except that the amounts of dispersant and acid used are 657 grams and 63 grams, respectively, for a molar ratio of dispersant to acid of approximately 1:2.4.

EXAMPLE 16

The preparation of Example 12 is repeated using the same borated Mannich base dispersant except that the amounts of dispersant and 37.5 wt. % $H_2SO_4$ used are 657 grams and 68 grams, respectively, for an approximate molar ratio of dispersant to acid of 1:2.6.

EXAMPLE 17

The preparation of Example 12 is repeated using the same borated Mannich dispersant except that the amounts of dispersant and 37% $H_2SO_4$ used are 657 grams and 68 grams, respectively, for an approximate molar ratio of dispersant to acid of 1:2.8.

EXAMPLE 18

The preparation of Example 12 was repeated using the same borated Mannich dispersant except that the amounts of dispersant and 37% $H_2SO_4$ used are 657 grams and 78 grams, for an approximate mole ratio of dispersant to acid of about 1:3.

EXAMPLE 19

Examples 1 to 6 are repeated using a Mannich dispersant prepared as follows having a high level of boron: Charge 446 grams of a solution of polybutylphenol in oil (50% active; 1600 m.w.), 24 grams tetraethylene pentaamine, 21 grams oleic acid, and 158 grams of SX-5 base oil to a reaction vessel and heat to 180° F. followed by slow addition of 21 grams of formalin. Maintain the reaction mixture at 190° F. for one hour then increase to 300°–320° F. and hold there for two hours while sparging with nitrogen. To the resulting reaction product (600 grams) was added 254 grams boric acid, 478 grams SX-5 base oil and 127 grams water, followed by heating to 240° F. At that temperature nitrogen sparging was begun, and the temperature was increased to 340° F. and mixed for 3 hours. The product was then cooled to 300° F. and filtered. The resulting borated Mannich dispersant had a nitrogen content of 0.6%, a boron content of 2.9% and an activity of 22%.

EXAMPLE 20

Charge 476 grams of a solution of polybutylphenol in oil (44.5% active; 1600 m.w.), 84 grams SX-5 base oil, 23 grams tetraethylene pentaamine, and 18.6 grams of a mixture of $C_{16}$–$C_{18}$ monobasic fatty acids commercially available as "Emery 984" from Emery Industries, Inc., to a reaction vessel and heat to 170° F. Add 18 cc formaldehyde and heat to 300°–320° F. with nitrogen sparging at 0.5 c.f.h. for 2 hours. The filtered product is crystal clear with a viscosity of 967 SSU at 210° F. To prepare a dispersant-$H_2SO_4$ adduct according to the present invention having a ratio of approximately 1 mole dispersant to 2 moles $H_2SO_4$, charge 395 grams of the Mannich dispersant prepared in this example (52% active; 2070 m.w.) to a reaction vessel and heat to 175° F. under nitrogen. Add 52 grams of 37.5% $H_2SO_4$ at once and heat slowly to 320° F. with a nitrogen purge. Maintain at 320° for four hours. The product is a clear dark oil.

EXAMPLE 21

Charge 446 grams of a solution of polybutylphenol in oil (50% active; 1600 m.w.), 24 grams tetraethylene pentaamine, 21 grams oleic acid, and 158 grams of SX-5 base oil to a reaction vessel and heat to 180° F. followed by slow addition of 21 grams of formalin. Maintain the reaction mixture at 190° F. for one hour then increase the temperature to 300°–320° F. and maintain there for two hours while sparging with nitrogen. A second formalin charge (37%, 31 grams) is added slowly followed by mixing at 300°–320° F. for one hour and nitrogen stripping for an additional two hours. The resultant Mannich base dispersant has a nitrogen content of 1.2% and an activity of 42%. To prepare a Mannich dispersant-$H_2SO_4$ adduct according to the present invention wherein the ratio of dispersant to $H_2SO_4$ is approximately 1:3, charge 493 grams of the Mannich product prepared in this example (42% active; 2071 m.w.) to a reaction vessel and heat to 175° F. under nitrogen. Add 78 grams of 37.5% $H_2SO_4$ at once and slowly heat the mixture to 320° F. with a nitrogen purge. Maintain the mixture at 320° for four hours to remove water. The product is a clear dark oil.

EXAMPLE 22

Example 21 is repeated except that the Mannich reaction product is borated to a level of 0.2 wt. % boron by the method of Example 5 prior to treatment with $H_2SO_4$.

EXAMPLE 23

Charge 400 grams of the Mannich base dispersant prepared according to the method of Example 21, 30 grams of the borated Mannich product prepared according to Example 19, and 7 grams of SX-5 base oil to a reaction vessel and mix under a nitrogen blanket for 24 hours. Charge 400 grams of the resulting borated Mannich dispersant (40% active; 2000 m.w.) to a reaction vessel and heat to 175° F. under nitrogen. Add 63 grams of 37.5 wt. % $H_2SO_4$ at once and heat the mixture slowly to 320° F. with a nitrogen purge. Maintain at 320° F. for four hours to remove water. The resulting dispersant-$H_2SO_4$ adduct is a clear dark oil.

EXAMPLE 24

Example 23 is repeated using the same borated Mannich dispersant except that the amounts of dispersant and 37.5% $H_2SO_4$ are 400 grams and 42 grams, respectively, for a molar ratio of dispersant to acid of approximately 1:2.

EXAMPLE 25

Example 23 is repeated using 400 grams of the dispersant and 46 grams of the 37.5% $H_2SO_4$ to obtain a molar ratio of dispersant to acid of approximately 1:2.2.

EXAMPLE 26

Example 23 is repeated using 400 grams of the dispersant and 50 grams of the acid to obtain a molar ratio of dispersant to acid of approximately 1:2.4.

EXAMPLE 27

Example 23 is repeated using 400 grams of the dispersant and 54 grams of the acid to obtain a molar ratio of dispersant to acid of approximately 1:2.6.

EXAMPLE 28

Example 23 is repeated using 200 grams dispersant and 59 grams acid to obtain a molar ratio of dispersant to acid of approximately 1:2.8.

EXAMPLE 29

Charge 374 grams of a solution of polybutylphenol in oil (50% active; 1600 m.w.), 27 grams of a blend of 3 parts by weight "DOW E-100" polyamine and 1 part tetraethylene pentaamine, 29 grams oleic acid, and 158 grams SX-5 base oil to a reaction vessel and heat to 180° F. Slowly add 24 grams of formalin. Hold at 190° F. for one hour then increase the temperature to 300°-320° F. and hold there for two hours while sparging with nitrogen. Slowly add a second charge of 38 grams of formalin. Mix at 300°-320° F. for one hour then strip with nitrogen for two hours. The finished dispersant has a nitrogen content of 1.5 wt. % and a activity of 43%. To prepare a Mannich dispersant-$H_2SO_4$ adduct according to the present invention wherein the mole ratio of dispersant to acid is approximately 1:2, charge 190 grams of the Mannich dispersant (2080 m.w.) of this example to a reaction vessel and heat to 175° F. Add 20.6 grams of 37.5% $H_2SO_4$ at once and slowly heat to 320° F. with a nitrogen purge. Maintain at 320° for four hours. The product is a clear dark oil.

EXAMPLE 30

The preparation of a Mannich dispersant-$H_2SO_4$ composition of Example 29 is repeated using the same dispersant prepared in that example except in the sulfation step the amounts of dispersant and 37.5% $H_2SO_4$ are 190 grams and 41.8 grams, respectively, to obtain a molar ratio of dispersant to acid of approximately 1:3.75.

EXAMPLE 31

Example 29 is repeated using 190 grams of the Mannich dispersant and 32.9 grams of 37.5% $H_2SO_4$ to obtain a molar ratio of dispersant to acid of approximately 1:3.

EXAMPLE 32

Example 29 is repeated using 191 grams of dispersant and 8.2 grams of acid to obtain a molar ratio of dispersant to acid of approximately 1:0.75.

EXAMPLE 33

Example 29 is repeated using 191 grams of dispersant and 4.1 grams acid to obtain a molar ratio of dispersant to acid of approximately 1:0.4.

EXAMPLE 34

Example 29 is repeated using 191 grams of dispersant and 2.06 grams of acid to obtain a mole ratio of dispersant to acid of approximately 1:0.2.

EXAMPLE 35

Charge 2250 grams of a solution of polybutylphenol in oil (50% active; 2250 m.w.), 129 grams of a polyamine mixture approximating tetraethylene pentaamine (commercially available from Dow Chemical Company under the tradename Dow E-100), 68 grams stearic acid, and 1050 grams SX-5 baseoil, to a reaction vessel and heat to 180° F. Slowly add 81 grams formalin. Maintain the reaction mixture at 190° F. for one hour and then increase to 320°-340° F. and maintain there for two hours while sparging with nitrogen. Add a second charge of formaldehyde (95 grams) slowly, followed by mixing at 300°-320° F. for one hour, and nitrogen stripping for an additional two hours. To prepare a Mannich base dispersant-$H_2SO_4$ adduct according to the present invention wherein the mole ratio of dispersant to acid is approximately 1:2, charge 595 grams of the Mannich base dispersant prepared in this example to a reaction vessel and heat to 175° F. under nitrogen. Add 52 grams of 37.5% $H_2SO_4$ at once. Heat the mixture slowly to 320° F. with a nitrogen purge. Maintain at 320° for four hours to remove water. The product is a clear dark oil.

EXAMPLE 36

The preparation of Example 35 is repeated using the same Mannich base dispersant except the amounts of dispersant and 37.5% $H_2SO_4$ used are 595 grams and 58 grams, respectively, to obtain a molar ratio of dispersant to acid of approximately 1:2.2.

EXAMPLE 37

The preparation of Example 35 is repeated using the same Mannich base dispersant except the amounts of dispersant and 37.5% $H_2SO_4$ used are 595 grams and 63 grams, respectively, to obtain a mole ratio of dispersant to acid of approximately 1:2.4.

EXAMPLE 38

The preparation of Example 35 is repeated using the same Mannich base dispersant except the amounts of dispersant and 37% $H_2SO_4$ used are 595 grams and 68 grams, respectively, to obtain a mole ratio of dispersant to acid of approximately 1:2.6.

EXAMPLE 39

The preparation of Example 35 is repeated using the same Mannich dispersant except the amounts of dispersant and 37.5% $H_2SO_4$ used are 595 grams and 73 grams, respectively, to obtain a mole ratio of dispersant to acid of approximately 1:2.8.

EXAMPLE 40

The preparation of Example 35 is repeated using the same Mannich base dispersant except that the amounts of dispersant and 37.5% $H_2SO_4$ were 595 grams and 78 grams, to obtain a mole ratio of dispersant to acid of approximately 1:3.

EXAMPLE 41

Charge 350 grams of the Mannich base dispersant (unsulfated) of Example 29, 28 grams of the borated Mannich dispersant of Example 19 (unsulfated) and 12 grams of SX-5 base oil to a reaction vessel and heat to 220° F. followed by mixing under a nitrogen blanket for 24 hours. The resulting borated Mannich dispersant has a boron content of 0.2%, a nitrogen content of 1.4% and an activity of 42%. To prepare an acid-treated dispersant according to the present invention wherein the mole ratio of dispersant to acid is approximately 1:3.75, charge 200 grams (0.042 moles) of the Mannich dispersant to a reaction vessel and heat to 175° F. Add 41.18 grams of 37.5% $H_2SO_4$ and heat slowly to 300° F. with a nitrogen purge. Maintain at 300° for several hours to remove water.

EXAMPLE 42

Example 41 is repeated using the same Mannich base dispersant except the amounts of dispersant and 37.5% $H_2SO_4$ used are 200 grams and 32.94 grams, respectively, to obtain a molar ratio of dispersant to acid of approximately 1:3.

EXAMPLE 43

Example 41 is repeated except the amounts of dispersant and acid are 200 grams and 20.59 grams, respectively, to obtain a molar ratio of dispersant to acid of about 1:2.

EXAMPLE 44

Example 41 is repeated using 200 grams of the dispersant and 8.23 grams of 37.5% $H_2SO_4$ to obtain a molar ratio of dispersant to acid of approximately 1:0.75.

EXAMPLE 45

Example 41 is repeated using 200 grams of dispersant and 4.11 grams of acid to obtain a molar ratio of dispersant to acid of approximately 1:0.4.

EXAMPLE 46

Example 41 is repeated using 200 grams dispersant and 2.06 grams acid to obtain a molar ratio of dispersant to acid of approximately 1:0.2.

EXAMPLE 47

Examples 41 to 46 were repeated except that the Mannich base dispersant was prepared as follows: Charge 1230 grams of a solution of polybutylphenol in oil (50% active; 1230 m.w.), 87 grams tetraethylene pentaamine, 70.5 grams oleic acid, 86 grams formalin, and 400 grams SX-5 base oil to a reaction vessel and heat to 190° F. and maintain there for one hour. Increase the temperature to 300°-320° F. and maintain there for two hours while sparging with nitrogen. Slowly add a second formalin charge (95 grams) followed by mixing at 300°-320° F. for one hour and nitrogen stripping for an additional two hours.

EXAMPLE 48

Charge 750 grams of a solution of polybutylsuccinic anhydride in oil (60% active; 2250 equivalent weight), 19 grams tetraethylenepentaamine, and 292 grams SX-5 base oil to a reaction. Heat to 320°-340° F. and mix for four hours while sparging with nitrogen. The product has a nitrogen content of 0.06% and an activity of 44%. To prepare a succinimide dispersant-$H_2SO_4$ adduct according to the present invention wherein the molar ratio of dispersant to acid is approximately 1:0.25, charge 107 grams (0.01 mols) of the succinimide dispersant prepared in this example to a reaction vessel and heat to 175° F. under nitrogen. Add 0.7 grams (0.0025 moles) of 37.5% $H_2SO_4$ at once and heat slowly to 300° F. with a nitrogen purge. After two hours at 300° F., heat the mixture to 350° F. and maintain there for 1.5 hours. The resulting sulfated dispersant is a clear, dark oil.

EXAMPLE 49

The preparation of Example 48 is repeated except that the H treatment step is carried out using 107 grams of dispersant and 1.3 grams of 37.5% $H_2SO_4$ to obtain a molar ratio of dispersant to acid of approximately 1:0.5.

EXAMPLE 50

Example 48 is repeated using a molar ratio of dispersant to acid of approximately 1:1.2.

EXAMPLE 51

Example 48 is repeated using a molar ratio of dispersant to acid of approximately 1:1.4

EXAMPLE 52

Example 48 is repeated using a molar ratio of dispersant to acid of 1:1.6.

EXAMPLE 53

Example 48 is repeated using a molar ratio of dispersant to acid of 1:1.8.

EXAMPLE 54

Example 48 is repeated using a molar ratio of dispersant to acid of 1:2.

EXAMPLE 55

Example 48 is repeated using a molar ratio of dispersant to acid of 1:2.2.

EXAMPLE 56

Example 48 is repeated using a molar ratio of dispersant to acid of 1:2.4.

EXAMPLE 57

Example 48 is repeated using a molar ratio of dispersant to acid of 1:2.6.

EXAMPLE 58

Example 48 is repeated using a molar ratio of dispersant to acid of 1:2.8.

EXAMPLE 59

Example 48 is repeated using a molar ratio of dispersant to acid of 1:3.

EXAMPLE 60

Example 48 is repeated using HCl instead of $H_2SO_4$.

EXAMPLE 61

Example 48 is repeated using $HMO_3$ instead of $H_2SO_4$.

EXAMPLE 62

The preparations of Examples 48–61 are repeated, except that the dispersant is borated to 0.3 wt % boron using a borating agent prepared as follows: Charge 309 grams boric acid, 185 grams toluene, and 370 grams isobutyl alcohol to a reaction vessel. Blanket with nitrogen and heat to 200°–230° F. Collect the water produced in the reaction and reflux the toluene and alcohol back to the reaction. Increase the temperatures to 260°–280° F. and strip with nitrogen until all the toluene is removed. Cool to 240° F. and filter. The boron content of the resulting product is 8.4%. To borate the dispersant of Example 48 charge 800 grams of the dispersant, 32 grams of the borating agent and 50 grams SX-5 to a reaction vessel and heat to 220° F., sparge with nitrogen, and blend for 14–18 hours. The resulting borated succinimide has a nitrogen content of 0.55%, a boron content of 0.3% and an activity of 40%.

EXAMPLE 63

The preparations of Examples 48 through 61 are repeated except that the succinimide dispersant is prepared using the following reactants: 750 grams of a solution of polybutylsuccinic anhydride in oil (60% active; 2250 equivalent weight), 38 grams tetraethylene pentaamine, and 320 grams SX-5 base oil. The resulting succinimide dispersant (2400 m.w.) has an activity of 44%, and a nitrogen content of 1.3%.

EXAMPLE 64

Examples 48 through 61 are repeated using the succinimide dispersant of Example 63, except that prior to the acid treatment the dispersant is borated to a level of 0.3 wt % boron according to the method of Example 62. The resulting dispersant has an activity of 40%, a nitrogen content of 1.1% and 0.3% boron.

EXAMPLE 65

The preparations of Examples 48 through Example 61 are repeated except the following reactants are used: 750 grams of a solution of polybutylsuccinic anhydride in oil (60% active; 2250 equivalent weight), 10.3 grams diethylenetriamine, and 285 grams SX-5 base oil. The resulting succinimide dispersant (4500 m.w.) has a nitrogen content of 0.4% and an activity of 44%.

EXAMPLE 66

The preparations of Examples 48 through 61 are repeated except that the succinimide is prepared using the following reactants: 666 grams of a solution of polybutylsuccinic anhydride in oil (57% active; 1900 equivalent weight), 28 grams of a mixture of amines approximating tetraethylenepentaamine (commercially available from the Dow Chemical Company under the tradename "DOW-E-100") and 215 grams SX-5 base oil. The resulting dispersant (4050 m.w.) has a nitrogen content of 0.77% and an activity of 44%.

EXAMPLE 67

The preparations of Examples 48 through 61 are repeated using the succinimide dispersant prepared in accordance with Example 66, except that the dispersant is borated to a level of 0.3% according to the procedures of Example 62. The resulting borated succinimide has a nitrogen content of 0.69% and activity of 40%.

EXAMPLE 68

The preparations of Examples 48 through 61 are repeated using the succinimide dispersant prepared in Example 66, except that prior to the acid treatment the succinimide is borated to a level of 0.3% in the following manner: Charge 500 grams of the succinimide, 60 grams of the borated Mannich dispersant of Example 6 and 20 grams of SX-5 to a reaction vessel. Heat to 220° F. and mix under nitrogen for 12–18 hours. The resulting borated succinimide has a nitrogen content of 0.7%, an activity of 40%, and a boron content of 0.3%.

EXAMPLE 69

The preparations of Examples 48 through 61 are repeated except that the succinimide dispersant is prepared using the following reactants: 666 grams of a solution of polybutylsuccinic anhydride in oil (60% active; equivalent weight 2000), 14.6 grams triethylenetetraamine, and 272 grams SX-5 base oil. The resulting dispersant (4100 m.w.) has a nitrogen content of 0.59% and an activity of 44%.

EXAMPLE 70

Examples 48 through 61 are repeated using the succinimide dispersant of Example 69, except that the dispersant is borated to a level of 0.3% prior to the acid treatment in accordance with the method of Example 62. The resulting dispersant has a nitrogen level of 0.6% and an activity of 40%.

EXAMPLE 71

Examples 48 through 61 are repeated except that the succinimide dispersant is prepared from the following reactants: 600 grams of a solution of polybutylsuccinic anhydride in oil (54% active; 1560 equivalent weight), 13.08 grams tetraethylenepentaamine, and 220 grams SX-5 base oil. The resulting product has a nitrogen content of 0.58% and an activity of 40%.

EXAMPLE 72

Examples 48 through 61 are repeated except that the succinimide dispersant is prepared from the following reactants: 597 grams of a solution of polybutylsuccinic anhydride in oil (62% active; 1850 equivalent weight), 19 grams of tetraethylene pentaamine, and 268 grams SX-5. The resulting dispersant (3850 m.w.) has a nitrogen content of 0.8% and an activity of 44%.

EXAMPLE 73

Examples 48 through 61 are repeated except the succinimide dispersant is prepared from the following reactants: 600 grams of a solution of polybutylsuccinic anhydride in oil (61.4% active; 1864 equivalent weight), 37.32 grams tetraethyl pentaamine, and 370 grams SX-5 base oil. The resulting dispersant (2050 m.w.) has a nitrogen content of 1.3% and an activity of 40%.

EXAMPLE 74

Examples 48 through 61 are repeated using the dispersant of Example 71 except that the dispersant is borated to a level of 0.3% boron using the borating agent and procedure of Example 62: 800 grams of the dispersant, 32 grams of the borating agent and 50 grams SX-5 are employed in the borating step. The finished borated dispersant (4800 m.w.) has an activity of 40% and a nitrogen level of 0.58.

EXAMPLE 75

Examples 48 to 61 are repeated using the dispersant of Example 72 except that the dispersant is borated to a level of 0.3% boron using the borating agent and procedures of Example 62: 800 grams of the dispersant, 32 grams of the borating agent and 50 grams of SX-5 are used. The finished borated dispersant (3850 m.w.) has an activity of 40% and a nitrogen content of 0.73.

EXAMPLE 76

Examples 48 through 61 are repeated using the dispersant of Example 72 except that the dispersant is borated to a level of 0.3% using the borating agent and procedures of Example 2: 800 grams of dispersant, 32 grams of the borating agent and 50 grams of SX-5 are the reactant amounts. The finished borated dispersant (2050 m.w.) has an activity of 40% and a nitrogen content of 1.36%.

EXAMPLE 77

Examples 48 to 61 are repeated except that the succinimide dispersant is prepared using the following reactants: 6000 grams of a solution of polybutylsuccinic anhydride in oil (64% active; 1309 equivalent weight), 184.8 grams tetraethylenepentaamine, and 1759 grams SX-5 base oil. The resulting succinimide dispersant (4060 m.w.) has a nitrogen content of 0.86 and an activity of 50%.

EXAMPLE 78

Examples 48 through 61 are repeated using the dispersant of Example 30 except that in the preparation of the dispersant ethylene diamine (58.62 grams) is substituted for TEPA, and 2801 grams of base oil are used. The resulting dispersant (3900 m.w.) has a nitrogen content of 0.46 and is 44% active.

EXAMPLE 79

Examples 48 to 61 are repeated using the dispersant of Example 30 except that in the preparation of the dispersant, 274 grams of "DOW E-100" amine (approximating TEPA) is used instead of TEPA, and the amount of base oil is adjusted to provide a 40% active dispersant.

EXAMPLE 80

Examples 48 to 61 are repeated using the dispersant of Example 30 except that in preparation of the dispersant 143 grams of triethylentetraamine are substituted for TEPA and 1820 grams SX-5 are used to obtain a dispersant having a nitrogen content of 0.68% and an activity of 50%.

EXAMPLE 81

Examples 48 to 61 are repeated using the dispersants of Examples 70, 77, 78 or 79, except that the dispersants are borated to 0.3% boron using the borating agent and procedures of Example 62.

EXAMPLE 82

Examples 48 to 61 are repeated except that the succinimide dispersant is prepared from the following reactants: 1677 grams of a solution of polybutylsuccinic anhydride in oil (64% active; 1400 equivalent weight), 72.4 grams tetraethylenepentaamine and 535 grams SX-5 base oil. The resulting dispersant (2950 m.w.) has a nitrogen content of 1.5% and an activity of 50%.

EXAMPLE 83

Examples 48 to 61 are repeated using the dispersant of Example 30 except that 39.5 grams of diethylenetriamine are substituted for TEPA in the preparation of the dispersant.

EXAMPLE 84

Examples 48 to 61 are repeated using the dispersant of Example 35 except 107 grams of Dow E-100 are substituted for TEPA in the preparation of the dispersant.

EXAMPLE 85

Examples 48 to 61 are repeated using the dispersant of Example 35 except that 23 grams of ethylene diamine are used instead of TEPA, and 792 grams SX-5 are used. The resulting dispersant has a nitrogen content of 0.43% and an activity of 44%.

EXAMPLE 86

Examples 48 to 61 are repeated using the dispersants of Examples 82, 83, 84 or 85 except that the dispersants are borated to a level of 0.3 using boric acid as described in U.S. Pat. No. 3,254,025.

EXAMPLE 87

Examples 48 to 61 are repeated using the dispersants of Examples 82, 83, 84 or 85 except that the dispersants are borated to 0.3% boron using the procedure of Example 68.

EXAMPLE 88

Examples 48 to 61 are repeated except that the succinimide dispersant is prepared from the following reactants: 5500 grams of a solution of polybutylsuccinic anhydride in oil (60% active; 1203 equivalent weight, 518 grams of tetraethylenepentaamine and 1518 grams SX-5 base oil. The resulting dispersant (1370 m.w.) has a nitrogen content of 2.5% nitrogen and an activity of 50%. The molecular weight of the dispersant is about 1370.

EXAMPLE 89

Examples 48 to 61 are repeated using the dispersant of Example 41 except that 282 grams of diethylenetriamine are substituted for TEPA in the preparation of the dispersant.

EXAMPLE 90

Examples 48 to 61 are repeated using the dispersant of Example 41 except that 767 grams of "DOW E-100" are substituted for TEPA.

EXAMPLE 91

Examples 48 to 61 repeated using the dispersant of Example 88 except that 164 grams of ethylenediamine are used instead of TEPA.

EXAMPLE 92

Examples 48 to 61 are repeated using the dispersant of Examples 88, 89, 90 or 92 except that the dispersants, prior to the acid treatment in Examples 14 to 14(1), are borated to a level of 0.1 to 1.0% boron using amylpolyborate prepared as follows; charge 309 grams of boric acid, 185 grams toluene and 440 grams amyl alcohol. Blanket with nitrogen and heat to 200°-230° F. Collect the water and reflux the toluene and alcohol back to the reactor. Increase the temperature to 260° to 280° F. and strip with nitrogen until all the toluene is removed. The resulting borate ester material has a boron content of about 8.5 to 8.9%. Sufficient amounts of the borating agent are combined with the dispersant and heated to 330° F. for four hours under a nitrogen purge to obtain boron levels of 0.1 to 1.0% in the dispersant. The activity of the dispersant can be adjusted by adding SX-5 base oil during the boration.

EXAMPLE 93

Examples 48 to 61 are repeated except that the succinimide dispersant is prepared from the following reactants: 5500 grams of a solution of polybutylsuccinic anhydride in oil (77% active; equivalent weight 910), 292 grams tetraethylenepentaamine and 1753 grams SX-5 base oil. The resulting dispersant has a nitrogen level of 1.4% and an activity of 60%.

EXAMPLE 94

Examples 48 to 61 are repeated using the dispersant of Example 46 except that 159 grams of diethylenetriamine are substituted for TEPA.

EXAMPLE 95

Examples 48 to 61 are repeated using the dispersant of Example 46 except that 225 grams of triethylenetetraamine are substituted for TEPA.

EXAMPLE 96

Examples 48 to 61 are repeated using the dispersants of Examples 93, 94, 95 or 96 borated in accordance with Example 92.

EXAMPLE 97

Examples 48 to 61 are repeated using a succinimide dispersant prepared from the following reactants: 5500 grams of a solution of polybutylsuccini anhydride in oil (77% active; 910 equivalent weight), 439 grams of tetraethylenepentaamine, and 1711 grams SX-5 base oil. The resulting product for a nitrogen level of 2.1% and activity of 50%.

EXAMPLE 98

Example 50 is repeated except the dispersant is borated to 0.5% boron using the method of Example 92.

EXAMPLE 99

A succinate ester-amide dispersant useful in the present invention is prepared as follows: charge 648 grams of polyethylene mixture corresponding roughly to tetraethylenepentaamine ("DOW E-100") to a reaction vessel and heat to 150° C. Add dropwise over a four hour period 265 grams of ethylene oxide to form an oxyethylated polyethyleneamine. Charge 61 grams of the oxyethylated polyethyleneamine, 787 grams of a solution of polybutylsuccinic anhydride in oil (64% active; 1400 equivalent weight) and 563 grams SX-5 base oil to a separate reaction vessel, heat at 195° C. for two hours under a mild nitrogen purge. The product is filtered and ready for use. To prepare a succinate ester-amide-$H_2SO_4$ composition of the present invention wherein the molar ratio of dispersant to acid is about 1:0.5, charge 235 grams dispersant (about 0.1 mole) to a reaction vessel and heat to 175° F. Add 13.1 grams of 37.5% $H_2SO_4$ (0.05 moles) and raise the temperature to 300° F. under a nitrogen purge and maintain at that temperature for 2 hours. The resulting product is a clear dark oil.

EXAMPLE 100

Example 99 is repeated using a molar ratio of dispersant to acid of approximately 1:0.8.

EXAMPLE 101

Examples 98 and 99 are repeated except that the succinate ester-amide dispersant is borated using the borating agent and procedures of Example 15 to obtain a dispersant which is 40% active having a boron level of 0.11 wt %.

EXAMPLE 102

Examples 99-101 were repeated except that the succinate ester-amide was prepared from the following reactants: 189 grams tetraethylenepentaamine and 74 grams ethylene oxide are used in preparing the ethoxylated amine; and 254 grams of the ethoxylated amine, 3924 grams of a solution of polybutylsuccinic anhydride in oil (64% active; 1932 equivalent weight) and 2735 grams of SX-5 are used in preparing the dispersant.

EXAMPLE 103

Examples 99 to 101 are repeated using a borated succinate ester-amide prepared from hydroxyethylated hexamethylenediamine and polybutylsuccinic anhydride as follows: charge 370 grams hexamethylenediamine to a reaction vessel and heat to 180° C. While stirring vigorously, add sufficient ethylene oxide over a period of 5½ hours until 562 grams have been added. Charge 35 grams of the hydroxyethylated hexamethylenediamine, 450 grams of a 50% active oil solution of polybutylsuccinic anhydride (1400 equivalent weight) and 165 grams SX-5 base oil to a reaction vessel. Heat at 190° C. for two hours with a mild nitrogen purge. A portion of this product is cooled down to 100° and treated with fifty milliliters of xylene and 5.9 grams of boric acid. The mixture is then refluxed at 140° C. with azeotropic removal of water and finally heated to 180° C. with a nitrogen purge to remove the xylene. The product (including base oil to 40% activity) is filtered with celite and contains 0.11% boron.

EXAMPLE 104

Examples 99–101 are repeated using a succinate ester-amide prepared from propoxylated hexamethylenediamine and polybutylsuccinic anhydride as follows: charge 262 grams of hexamethylenediamine to a reaction vessel and heat to 150° C. Add dropwise over a four hour period, with stirring, 415 grams of propylene oxide, until the reaction mass gains 395 grams. Charge 166 grams of the propoxylated hexamethylenediamine (0.571 moles), 1600 grams of a 50% active solution in oil of polybutylsuccinic anhydride having an equivalent weight of 1400, and 649 grams SX-5 base oil to a reaction vessel and heat at 190° C. for two hours under a mild nitrogen purge.

EXAMPLE 105

Examples 99 to 101 are repeated using the dispersant of Example 57 except the dispersant is borated using the borating agent and procedure of Example 92. The finished dispersants are 40% active and contain 0.1% boron.

EXAMPLE 106

Examples 99–101 are repeated using a succinate-ester-amide dispersant prepared as follows: charge 262 grams of hexamethylenediamine to a reaction vessel and heat to 150° C. Add dropwise over a four hour period, with stirring, 262 grams of propylene oxide, to obtain propoxylated HMDA incorporating about 2 moles propylene oxide per mole of hexamethylenediamine. Charge 24.9 grams (0.107 moles) of the propoxylated HMDA, 300 grams of a 50% active solution in oil of polybutylsuccinic anhydride (1400 equivalent weight) and 112 grams SX-5 base oil to a reaction vessel and heat at 190° C. for two hours. Two hundred grams of the resulting product (0.0490 moles) is treated with 15.2 grams boric acid (0.246 moles) and eight grams of water at 82° C. for ninety minutes and then at 170° C. for two hours followed by filtration through celite.

CATERPILLAR VITON® TESTING

EXAMPLE 107

A borated Mannich base dispersant-$H_2SO_4$ reaction product of the present invention prepared according to the preceding Examples and containing from 2 to 3 moles $H_2SO_4$ per mole of dispersant (i.e., about 1.3 to about 2 times the amount of acid necessary to neutralize the dispersant) was compared with the same Mannich dispersant, untreated, in the Caterpillar test to determine the effects of the dispersant on a fluorocarbon ("Viton®") engine seal. The test was carried out by suspending the fluorocarbon seal in a formulated oil (base stocks, 87%; dispersant/acid reaction product, 5.46%; low base calcium sulfonate, 1.99%; high base sulfurized calcium phenate, 0.73%; low base sulfurized calcium phenate 1.51%; zinc dithiophosphate, 2.36%; ethoxylated nonylphenol, 0.23%; SX-5, 1.25%) for 10 days at 300° F. after which the $-\Delta E$, or percent reduction in elongation (compared to a non-immersed seal) was measured. The results of this test are set forth in TABLE I, below. Data was obtained for the formulation containing no additional boron (except that provided by the dispersant) and containing 380 ppm boron added by blending the formulation with the amyl-polyborate of Example 92.

TABLE I

| Molar Ratio of Dispersant to $H_2SO_4$ | $-\Delta E$* (0 Add'l. Boron) | $-\Delta E$* (380 ppm Boron) |
|---|---|---|
| (Untreated) | 46 | 36 |
| 1:2 | 42 | 21 |
| 1:2.2 | 37 | 25 |
| 1:2.4 | 32 | 14 |
| 1:2.6 | 31 | 17 |
| 1:2.8 | 30 | 19 |
| 1:3.0 | 29 | 12 |

* $-\Delta E \leqq 38$ is passing

EXAMPLE 108

A polybutenylsuccinimide dispersant-$H_2SO_4$ reaction product of the present invention prepared according to the preceding examples and containing from 0.25 to 2.0 moles acid per mole of dispersant (i.e., about 0.17 to 1.3 times the amount of acid necessary to neutralize the dispersant) was tested for Viton® seal compatibility in the manner of Example 107 in a lubricant additive formulation containing base stocks 80.89%, an oxidized ethylene-propylene copolymer VI improver 7.4%, high base magnesium sulfonate 0.55%, zinc dialkyldithiophosphate 1.58%, alkylated diphenyl-amine antioxidant 0.25%, a high base sulfurized calcium phenate 1.94%, and the polybutylsuccinimide/$H_2SO_4$ adduct of the present invention (40% active both unborated and borated to 0.3 wt %) 7%.

TABLE II

| Molar Ratio of Dispersant to $H_2SO_4$ | $-\Delta E$* (0.2% B) | $-\Delta E$* (No B) |
|---|---|---|
| (Untreated) | 12 | — |
| 1:0.25 | 8 | — |
| 1:0.50 | −1 | 11 |
| 1:1 | −1 | 9 |
| 1:2 | — | 1 |

* $-\Delta E \leqq 10$ is passing

EXAMPLE 109

A polybutylsuccinimide dispersant of different molecular weight than that tested in Example 63 was tested for engine seal compatibility using the test procedures of Example 107. The dispersant (40% active) was tested in a formulation containing no boron and 380 ppm boron. The results are shown in Table III below.

TABLE III

| Molar Ratio of Dispersant to $H_2SO_4$ | $-\Delta E$* (No Boron) | $-\Delta E$* (380 ppm B.) |
|---|---|---|
| (Untreated) | 38 | 35 |
| 1:1 | 32 | 26 |
| 1:1.2 | 34 | 23 |
| 1:1.4 | 34 | 22 |
| 1:1.6 | 32 | 22 |
| 1:1.8 | 30 | 20 |
| 1:2.0 | 32 | 20 |
| 1:2.2 | 29 | 16 |
| 1:2.4 | 27 | — |
| 1:2.6 | 28 | 17 |
| 1:2.8 | 26 | — |
| 1:3.0 | 27 | 15 |

* $-\Delta E \leqq 36$ is passing

EXAMPLE 110

This Example demonstrates that a formulated additive package containing a borated Mannich dispersant-$H_2SO_4$ reaction product of the present invention prepared according to the Examples can pass engine seal compatibility tests even when the formulation also contains a polymeric Mannich dispersant-VI improver. Such a formulation is typically very harmful to Viton® seals and difficult to pass in the Caterpillar Viton® test. The tested formulation was that of Example 107 except it further included 7% of a Mannich dispersant VI improver obtained by reacting an oxidized ethylene-propylene copolymer, an amine and aldehyde. The formulation was tested with no additional boron (other than that contributed by the 40% active 0.2% borated dispersant-acid composition) and with 0.45% boron added by blending the formulation with amylpolyborate containing 8–9% boron (Example 92). The results are set forth in Table IV below.

TABLE IV

| Molar Ratio of Dispersant to $H_2SO_4$ | $-\Delta E$* (0 add'l. B) | $-\Delta E$* (0.45 add'l. B) |
|---|---|---|
| (Untreated) | 17 | 16 |
| 1:2 | 22 | 4 |
| 1:2.2 | 11 | 1 |
| 1:2.4 | 10 | −2 |
| 1:2.6 | 6 | −7 |
| 1:2.8 | 9 | −6 |
| 1:3 | 0 | −8 |

* $-\Delta E \leqq 10$ is passing

EXAMPLE 111

This example demonstrates that a formulated additive package containing polybutenylsuccinimide dispersant-$H_2SO_4$ reaction products of the present invention can pass Viton® seal tests even when the formulation also contains a polymeric (ethylene-propylene) Mannich dispersant-VI improver. The tested formulation was similar to Example 108. The formulation was tested at 0 and 0.45% boron. The results are set forth in Table V below. Two succinimideacid dispersants were tested. They differed only in the molecular weight of the polybutylsuccinic anhydride.

TABLE V

| Molar Ratio of Dispersant (I) to $H_2SO_4$ | $-\Delta E$* (0% Boron) | $-\Delta E$* (0.45% Boron) |
|---|---|---|
| (Untreated) | 43 | 35 |
| 1:1 | 40 | 35 |
| 1:4 | 39 | 38 |
| 1:2.0 | 34 | 28 |
| 1:2.4 | 34 | 22 |
| 1:3.0 | 35 | 25 |
| **Molar Ratio of Dispersant (II) to $H_2SO_4$** | **$-\Delta E$* (0% Boron)** | **$-\Delta E$* (0.45% Boron)** |
| (Untreated) | 41 | — |
| 1:0.5 | 39 | 20 |
| 1:1 | 38 | — |
| 1:2 | 30 | — |

* $-\Delta E \leqq 23$ is passing

VW VITON® TESTING

EXAMPLE 112

Engine seal compatibility of a Mannich base dispersant-$H_2SO_4$ reaction product prepared according to the preceding Examples was evaluated in the VW Viton® test, a test similar to the Caterpillar test described in Example 107 except the test is carried out by suspending the engine seal in the formulated oil for 4 days for 300° F. after which the "Δ modulus" is measured and "crazing" or cracking of the seal is observed and assigned a rating of H (heavy), M (medium), L (light), VL (very light) and N (no crazing). The absence of crazing is particularly critical in the VW Viton test. In this series of tests the Mannich base dispersant-$H_2SO_4$ reaction product containing 0, 0.5, 1, 1.5 or 2 moles of $H_2SO_4$ per mole of dispersant was included in five DI packages which in turn were blended with base stocks to obtain a finished lubricant oil formulation. The results are set forth in TABLE VI(a) and (b) below:

TABLE VI(a)

| Six Formulations Tested in VW Viton | | | | | | |
|---|---|---|---|---|---|---|
| Component (wt %) | (1) I | (1) II | (1) III | (1) IV | (1) V | (2) VI |
| Base stocks | 86.96 | 80.00 | 82.62 | 83.96 | 84.96 | 83.26 |
| Oxidized E-P copolymer VI improver | 9.0 | 9.0 | 9.0 | — | — | 9.2 |
| VI improver | — | — | — | 6.2 | 6.0 | — |
| Zinc dialkyldithiophosphate | 1.04 | 1.10 | 1.35 | 1.35 | 1.35 | 1.04 |
| High base magnesium sulfonate | 1.00 | 1.10 | 0.90 | 0.90 | 0.90 | 1.10 |
| Low base calcium sulfonate | 0.90 | 1.25 | 0.40 | 2.65 | 2.65 | — |
| Alkylated diphenylamine antioxidant | .30 | — | — | — | — | — |
| Sulfurized olefin oxidation inhibitor | .30 | .50 | .28 | .57 | .57 | — |
| Acryloid 150 | — | — | — | — | — | .30 |
| High base sulfurized calcium phenate | 1.25 | .55 | 1.37 | .57 | .57 | .90 |
| 1 mole disperant: X moles $H_2SO_4$ | 5.0 | 5.8 | 4.9 | 3.0 | 3.0 | 4.2 |

TABLE VI(b)

| VW Viton Results (Change in Modulus, Crazing)[1,2] | | | | | | |
|---|---|---|---|---|---|---|
| "X" (from Table VI (a)) | Formulation I | II | III | IV | V | VI |
| 0 | 33 M–H | 32 H | 39 H | 34 M–H | 37 H | 25.8 M |
| .25 | — | — | — | — | — | 19.8 M |
| .5 | 20 L–M | 38 H | 38 H | 18 M | 37 H | 18.2 L |
| 1.0 | 8 VL–L | 38 H | 23 M | 22 L | 36 H | 8.8 N |
| 1.5 | 5 N | 38 H | 14 N | 15 VL–L | 27 M | 5.0 N |
| 2.0 | 1 N | 27 L | 9 VL–N | 7 VL | 18 L | 4.3 N |

[1]H = heavy, M = medium, L = light, VL = very light, N = No
[2]Passing: Modulus less than 25 Crazing = VL or N

EXAMPLE 113

In this Example, bench corrosion testing (the "Amihot" procedure) of dispersant $H_2SO_4$ adducts demonstrated, surprisingly, that the acid treatment of dispersants according to the present invention does not materially increase the bearing corrosion tendency of a formulated oil containing the dispersants. Mannich and succinimide dispersants treated with acid according to the present invention were tested in the following formulation: base oil, zinc dialkyldithiophosphate, 0.72%; sulfurized olefin, 0.60; low base calcium sulfonate, 1.24%; high base calcium sulfonate, 0.67%; high base magnesium sulfonate, 0.76%; VI improver, 7.40%; dispersant, 4.4–6.6%. The Amihot Bearing corrosion test evaluates the bearing corrosion tendencies of oils due to oxidation and correlates very well with the CRC L-38 engine test. In the Amihot procedure 100 grams of the test oil were oxidized at 325° F. in an open oxidation tube. The sample was blown with 30 cc air/minute. Oxidation was catalyzed by the addition of 1% of an equimolar mixture of 1,2-dichloroethane and 1,2-dibromoethane. During the 20 hour test a lead coupon was immersed in the oil. Weight loss of the coupon is measured at the end of the test. A weight loss of 2 mg or less of the lead coupon indicates a passing L-38 test. Table VII sets forth the results of the Amihot test and clearly demonstrates that oils formulated with dispersant/$H_2SO_4$ adducts of the present invention can comfortably pass lead corrosion tests.

TABLE VII

Amihot Testing of Dispersant $H_2SO_4$ Adducts

| Dispersant Type | Wt % in Formulation | Mole Ratio of Acid to Disp. | Change in Lead Coupon wt. (mg) |
|---|---|---|---|
| Mannich-$H_2SO_4$ | 6.6 | (no acid) | −0.1 |
| Mannich-$H_2SO_4$ | 6.6 | 2.1 | −0.8 |
| Mannich-$H_2SO_4$ | 6.6 | 2.4:1 | 0 |
| Mannich-$H_2SO_4$ | 6.6 | 3:1 | −1.1 |
| succinimide-$H_2SO_4$ | 5.3 | (no acid) | 0 |
| succinimide-$H_2SO_4$ | 5.3 | 1:1 | 0 |
| succinimide-$H_2SO_4$ | 5.3 | 1:2 | −0.6 |
| succinimide-$H_2SO_4$ | 5.3 | 1:3 | −0.4 |

SPOT DISPERSANCY TESTING

EXAMPLE 114

Dispersant-acid adducts prepared according to the present invention were found comparable in spot dispersancy testing to the same dispersants without the acid treatment of this invention. In contrast however, treatment of a succinimide or Mannich dispersants with an organic acid (C-20 alkyl sulfonate) dramatically worsened dispersant performance as measured in the bench test. Testing carried out by placing a drop of sludge (from a used oil) plus the dispersant onto a test paper and calculating the ratio of the sludge ring to the oil ring. A score of 100 is ideal indicating that the sludge ring was expanded to a diameter equalling the oil test spot. Table VIII below demonstrates that dispersant treatment with $H_2SO_4$ did not affect dispersant performance, although a similar treatment with C-20 alkylsulfonate was markedly detrimental.

TABLE VIII

Spot Dispersancy of Dispersant-Acid Adducts

| Dispersant | Molar Ratio of Acid to Dispersant | Acid Used | Spot Dispersancy Results |
|---|---|---|---|
| Mannich | (no acid) | — | 79 |
| Mannich | 2:1 | $H_2SO_4$ | 84 |
| Mannich | 3:1 | $H_2SO_4$ | 88 |
| succinimide | (no acid) | — | 73 |
| succinimide | 1.3:1 | $H_2SO_4$ | 73 |
| succinimide | 1.7:1 | $H_2SO_4$ | 73 |
| SEA* | (no acid) | — | 64 |
| SEA | 0.5:1 | $H_2SO_4$ | 64 |
| SEA | 0.8:1 | $H_2SO_4$ | 64 |
| Mannich | 3:1 | C—20 $SO_3H$ | 39 |
| succinimide | 3:1 | C—20 $SO_3H$ | 50 |

*succinate ester amide

WATER SENSITIVITY TESTING

In addition to the engine seal compatibility benefits provided by the acid/dispersant compositions of the present invention, there is a further advantage obtained in finished oil formulations which contain the dispersant/acid adducts along with other additives, namely, a marked improvement in the avoidance of haze and sediment during storage. The following Example illustrates this advantage.

EXAMPLE 115

A Mannich dispersant/$H_2SO_4$ adduct prepared in accordance with the preceding Examples was included in a lubricant formulation having the following components: dispersant/$H_2SO_4$, 4.37%; low base calcium sulfonate, 1.99%; high base sulfurized calcium phenate, 0.73%; low base sulfurized calcium phenate, 1.51%; high base magnesium sulfonate, 0.56; zinc dialkyldithiophosphate 2.36%; alkoxylated n-alkyl phenol, 0.23%; SX-5 base oil, 0.15%; 10W oil, 52.2%; and 5W oil, 34.8%. Samples of the oils were tested at 130° F. at varying levels of added water. The water tolerance results are reported in Table IX below in terms of the number of days required for the formulation to develop unacceptable haze or sediment at a particular level of added water.

TABLE IX

Water Sensitivity Testing

| Mole Ratio of Dispersant to $H_2SO_4$ | Days Required to Obtain Unacceptable Haze/Sediment | Amount of Added $H_2O$ | Storage Temp. |
|---|---|---|---|
| (untreated) | 9 | 0.10–0.15 | 130° F. |
| 1:0.2 | 9 | 0.10–0.15 | 130° F. |
| 1:0.4 | 9 | 0.10–0.15 | 130° F. |
| 1:0.75 | 9 | 0.10–0.15 | 130° F. |
| 1:2.0 | 38(1) | 0.20 | 130° F. |
| 1:3.0 | 38(1) | 0.20 | 130° F. |

(1)Test was terminated at 38 days before any haze or sediment developed.

ENGINE TESTING

EXAMPLE 116

L-38 TESTING OF SUCCINIMIDE $2H_2SO_4$

A succinimide-H adduct of the present invention having about 2 moles of acid per mole of dispersant, i.e., roughly sufficient acid to neutralize the basic amine nitrogens of the dispersant, was compared with the same dispersant, unacidified, in the L-38 bearing corrosion test. The formulation tested was as follows: 80% base stocks; 6.5 to 7.5% polymeric Mannich dispersant-VI improver; 0.55% high base magnesium sulfonate; 1.58% zinc dialkyldithiophosphate; 0.25% diphenylamine antioxidant; 1.94% high base sulfurized calcium phenate; 0.20% Acryloid 150 pour point depressant; 3.00% succinate ester-amide dispersant; and 4–5% borated (0.3 to 0.4% boron) succinimide dispersant. It was found that the formulation containing the unacidified succinimide dispersant (4%) had an L-38 bearing wt. loss of 8.2 mg, whereas the same formulation with 5.00% succinimide $H_2SO_4$ had a bearing weight loss of 7.7 mg. This result clearly demonstrates that the acid treatment of the present invention does not affect the corrosion tendency of the finished oil.

EXAMPLE 117

SEQUENCE V-D TESTING OF MANNICH $3H_2SO_4$

A Mannich dispersant was treated with $H_2SO_4$ in accordance with the present invention to obtain a Mannich-H adduct wherein the molar ratio of dispersant to acid is about 1:3. The dispersant-$H_2SO_4$ adduct was included in a ubricant formulation (I) having the following components: base stocks, 81.56%; polymeric ethyleneepropylene polymer VI improver, 7.8%; zinc dialkyldithiophosphate, 1.43%; sulfurized olefin, 0.60%; low base calcium sulfonate, 1.24%; high base calcium sulfonate, 0.67%; high base magnesium sulfonate, 0.76%; high basessulfurized calcium phenate, 1.24%; dispersant/$H_2SO_4$ adduct, 6.60%. This formulation was compared to a formulation (II) which was identical except that the Mannich-$H_2SO_4$ was replaced with an equivalent amount of a succinate ester-amide dispersant. The V-D results are set forth in Table X, below.

TABLE X

| | Sequence V-D Results | |
|---|---|---|
| | Formulation II (succinate ester-amide) | Formulation I Mannich . $3H_2SO_4$ |
| Average Sludge(1) | 9.44 | 9.63 |
| Average Varnish(2) | 8.25 | 7.87 |
| Piston Varnish(3) | 7.68 | 7.61 |
| Wear Max(4) | 0.7 | 0.7 |
| Avg.(5) | 0.6 | 0.6 |

(1)Passing: >9.4
(2)Passing: >6.6
(3)Passing: >6.7
(4)Passing: <2.5
(5)Passing: <1.0

EXAMPLE 118

Sequence V-D testing and CAT 1G2 testing were carried out using a succinimide-$H_2SO_4$ adduct of the present invention wherein the molar ratio of dispersant to acid was approximately 1:2, which corresponds to an amount of acid in slight excess of that found empirically to neutralize the amine nitrogens of the dispersant. Formulation I contained: 81.2% base stocks; 7.00% ethylene-propylene Mannich dispersant/VI improver; 3.00% borated succinate ester/amide dispersant; 1.40% high base sulfurized calcium phenate; 1.00% low base calcium sulfonate; 0.55% high base magnesium sulfonate; 1.30% zinc dialkyldithiophosphate; 0.40% diphenylamine anti-oxidant; 20% Acryloid 150 pour point depressant; 0.15% SX-5 oil; and 3.50% succinimide.$H_2SO_4$. Formulation II was identical except that the same succinimide without $H_2SO_4$ was tested. The results are set forth in Table XI below.

TABLE XI

| Sequence V-D CAT 1G2 Testing Succinimide . $2H_2SO_4$ | | |
|---|---|---|
| CAT 1G2 (480h) | Formulation I | Formulation II |
| Top Groove Fill | 70 | 75 |
| Weighted Lacquer Demerits | 88 | 177 |
| Weighted Carbon Demerits | 189 | 154 |
| Weighted Total Demerits(1) | 260 | 275 |
| Sequence V-D | Formulation I | Formulation II |
| Average Sludge(2) | 9.7 | 9.71 |
| Average Varnish(3) | 7.26 | 8.54 |
| Piston Varnish(4) | 7.45 | 8.44 |
| Wear Max.(5) | 0.20 | 0.20 |
| Wear Avg.(6) | 0.16 | 0.16 |

(1)Passing: <300
(2)Passing: >9.4
(3)Passing: >6.6
(4)Passing: >6.7
(5)Passing: <2.5
(6)Passing: <1.0

I claim:

1. A dispersant composition comprising the reaction product obtained upon reaction of ashless Mannich dispersants, with an inorganic mineral acid selected from the group consisting of sulfuric, nitric and hydrochloric acids at a temperature of from about 200° to about 400° F. and wherein the amount of acid reacted with the dispersant is from about 25% to about 300% of that required to neutralize the dispersant.

2. The dispersant composition of claim 1 wherein the amount of acid is from about 100 to about 200% of that required to neutralize the dispersant.

3. The dispersant composition of claim 1 wherein the acid is nitric.

4. The dispersant composition of claim 1 wherein the acid is hydrochloric.

5. The dispersant composition of claim 1 wherein the acid is sulfuric.

6. The dispersant composition of claim 1 wherein the ashless dispersant is a Mannich base dispersant obtained by reaction of (i) a high molecular weight alkyl-substituted hydroxyaromatic wherein the alkyl substituent is a polybutyl group having a number average molecular weight of about 600–5000; (ii) an alkylene polyamine having the general formula $H_2N$-(A-NH)$_x$-H wherein A is a divalent alkylene radical having 2 to 6 carbon atoms and x is an integer from 1 to 10; and (iii) an aldehyde.

7. The dispersant composition of claim 6 wherein the acid is sulfuric and the mole ratio of acid to dispersant is about 1.5:1 to about 3.5:1.

8. The dispersant composition of claim 6 wherein the acid is nitric and the mole ratio of acid to dispersant is about 3:1 to about 7:1.

9. The dispersant composition of claim 6 wherein the acid is hydrochloric and the mole ratio of acid to dispersant is about 3:1 to about 7:1.

10. An additive package formulated for addition to lubricating oil to obtain a formulated motor oil suitable for use in an internal combustion engine, comprising: a diluent and a dispersant composition comprising the reaction product obtained upon reaction of ashless Mannich dispersants, with an inorganic mineral acid selected from the group consisting of sulfuric, nitric and hydrochloric acids at a temperature of from about 200° to about 400° F. and wherein the amount of acid reacted with the dispersant is from about 25% to about 300% of that required to neutralize the dispersant.

11. The additive package of claim 11 wherein the amount of acid is from about 100 to about 200% of that required to neutralize the dispersant.

12. The additive package of claim 10 the acid is nitric.

13. The additive package of claim 10 wherein the acid is hydrochloric.

14. The additive package of claim 10 wherein the acid is sulfuric.

15. The additive package of claim 10 wherein the ashless dispersant is a Mannich base dispersant obtained by reacting (i) a high molecular weight alkyl-substituted hydroxyaromatic wherein the alkyl substituent is a polybutyl group having a number average molecular weight of about 600-5000; (ii) an alkylene polyamine having the general formula $H_2N$-(A-NH)$_x$-H wherein A is a divalent alkylene radical having 2 to 6 carbon atoms and x is an integer from 1 to 10; and (iii) an aldehyde:

16. The additive package of claim 15 wherein the acid is sulfuric and the mole ratio of acid to dispersant is about 1.5:1 to about 3.5:1.

17. The additive package of claim 15 wherein the acid is nitric and the mole ratio of acid to dispersant is about 3:1 to about 7:1.

18. The additive package of claim 15 wherein the acid is hydrochloric and the mole ratio of acid to dispersant is about 3:1 to about 7:1.

19. The additive package of claim 16 further comprising alkaline earth metal sulfonate and alkaline earth metal phenate wherein the phenate is optionally sulfurized.

20. The additive package of claim 19 further comprising a zinc dialkyldithiophosphate and/or a succinimide or succinate ester/amide dispersant which dispersant has not been treated with acid.

21. A lubricating oil composition comprising a major amount of an oil or lubricating viscosity and a minor amount of dispersant composition, wherein the dispersant composition comprises: the reaction product of ashless Mannich dispersants, with an inorganic mineral acid selected from the group consisting of sulfuric, nitric and hydrochloric acids at a temperature of from about 200° to about 400° F. and wherein the amount of acid reacted with the dispersant is from about 25% to about 300% of that required to neutralize the dispersant.

22. The composition of claim 21 wherein the amount of acid is from about 100 to about 200% of that required to neutralize the dispersant.

23. The composition of claim 21 wherein the acid is nitric.

24. The composition of claim 21 wherein the acid is hydrochloric.

25. The composition of claim 21 wherein the acid is sulfuric.

26. The composition of claim 21 wherein the ashless dispersant is a Mannich base dispersant obtained by reacting (i) a high molecular weight alkyl-substituted hydroxyaromatic wherein the alkyl substituent is a polybutyl group having a number average molecular weight of about 600–5000; (ii) an alkylene polyamine having the general formula $H_2N$-(A-NH)$_x$-H wherein A is a divalent alkylene radical having 2 to 6 carbon atoms and x is an integer from 1 to 10; and (iii) an aldehyde.

27. The composition of claim 26 wherein the acid is sulfuric and the mole ratio of acid to dispersant is about 1.5:1 to about 3.5:1.

28. The composition of claim 26 wherein the acid is nitric and the mole ratio of acid to dispersant is about 3:1 to about 7:1.

29. The composition of claim 26 wherein the acid is hydrochloric and the mole ratio of acid to dispersant is about 3:1 to about 7:1.

30. The composition of claim 27 further comprising a viscosity index improver selected from the group consisting of (i) an oxidized ethylene-propylene copolymer, and (ii) the annich reaction product of an oxidized ethylene-propylene copolymer, an amine, and an aldehyde.

31. The composition of claim 30 further comprising alkaline earth metal sulfonate and alkaline earth metal phenate, wherein the phenate is optionally sulfurized.

32. The composition of claim 31 further comprising a zinc dialkyldithiophosphate and/or a succinimide or succinate ester/amide dispersant, which dispersant is not pretreated with acid.

* * * * *

UNITED STATES PATENT OFFICE
CERTIFICATE OF CORRECTION

Patent No. 4,889,646 Dated December 26, 1989

Inventor(s) Paula R. Vettel

It is certified that error appears in the above-identified patent and that said Letters Patent is hereby corrected as shown below:

| Column | Line | |
|---|---|---|
| 25 | 18 | "0.58" should read --0.58%-- |
| 25 | 27 | "0.73" should read --0.73%-- |
| 25 | 46 | "0.86" should read --0.86%-- |
| 25 | 55 | "0.46" should read --0.46%-- |
| 34 | 67-68 | "Mannich-H" should read --Mannich-$H_2SO_4$-- |

Signed and Sealed this

Thirtieth Day of April, 1991

*Attest:*

HARRY F. MANBECK, JR.

*Attesting Officer*

*Commissioner of Patents and Trademarks*